US007653320B2

(12) United States Patent
Ota et al.

(10) Patent No.: US 7,653,320 B2
(45) Date of Patent: Jan. 26, 2010

(54) IMAGE FORMING SYSTEM AND CONTROL METHOD THAT CHANGE SEQUENCE OF IMAGE FORMATION BASED ON FIXATION METHOD

(75) Inventors: Mitsuhiro Ota, Toride (JP); Shigeo Hata, Toride (JP); Naohisa Nagata, Moriya (JP); Takeo Yamamoto, Abiko (JP); Daisaku Kamiya, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 17 days.

(21) Appl. No.: 11/859,420

(22) Filed: Sep. 21, 2007

(65) Prior Publication Data

US 2008/0075490 A1 Mar. 27, 2008

(30) Foreign Application Priority Data

Sep. 26, 2006 (JP) ..... 2006-261414

(51) Int. Cl.
*G03G 13/20* (2006.01)

(52) U.S. Cl. ..... 399/45; 399/67; 399/68; 399/76; 399/77; 399/328; 219/216

(58) Field of Classification Search ..... 399/45, 399/67–69, 76–77, 328–330, 341, 400; 219/216
See application file for complete search history.

(56) References Cited

U.S. PATENT DOCUMENTS 5,981,121 A 11/1999 Ide
6,980,762 B2 * 12/2005 Bogoshian ..... 399/328
2006/0083562 A1 4/2006 Matsumoto et al. ..... 399/329

FOREIGN PATENT DOCUMENTS

| | | | |
|---|---|---|---|
| JP | 10-123863 | | 5/1998 |
| JP | 2001-27499 | | 10/2001 |
| JP | 2001-274999 | | 10/2001 |
| JP | 2005-010292 | | 1/2005 |
| JP | 2005-099759 | | 4/2005 |
| JP | 2005212443 A | * | 8/2005 |

OTHER PUBLICATIONS

Machine Translation of JP 2001274999 A, by Takamiya et. al.*

* cited by examiner

*Primary Examiner*—David M Gray
*Assistant Examiner*—G. M. Hyder
(74) *Attorney, Agent, or Firm*—Fitzpatrick, Cella, Harper & Scinto

(57) ABSTRACT

An image forming system includes an image forming unit which forms an image as a toner image on a printing medium, a first fixing unit which fixes, on the printing medium, the toner image formed by the image forming unit, a second fixing unit arranged at a position different from the first fixing unit and used when a larger amount of heat is necessary for fixing the toner image on the printing medium, and a changing unit which changes the sequence of image formation by the image forming unit when the second fixing unit is used during image formation.

18 Claims, 19 Drawing Sheets

FIG. 3C

| JOB NO. 1 | | | |
|---|---|---|---|
| NUMBER OF OUTPUT PAGES | PAPER SIZE : A3 | MIX MODE FLAG | |
| OUTPUT SEQUENCE | PAPER TO BE USED | FIXING DEVICE USE FLAG | IMAGE DATA |
| PAGE 1 | PLAIN PAPER | FIRST FIXING DEVICE | IMAGE DATA 1 |
| PAGE 2 | PLAIN PAPER | FIRST FIXING DEVICE | IMAGE DATA 2 |
| PAGE 3 | SPECIALTY PAPER | SECOND FIXING DEVICE | IMAGE DATA 3 |
| PAGE 4 | PLAIN PAPER | FIRST FIXING DEVICE | IMAGE DATA 4 |
| PAGE 5 | PLAIN PAPER | FIRST FIXING DEVICE | IMAGE DATA 5 |
| OTHER IMAGE FORMING CONDITIONS | | | |

IMAGE FORMING SYSTEM AND CONTROL METHOD THAT CHANGE SEQUENCE OF IMAGE FORMATION BASED ON FIXATION METHOD

BACKGROUND OF THE INVENTION

1. Field of the Invention

The present invention relates to an image forming system including an image forming apparatus having a plurality of fixing units, and a method of controlling the image forming apparatus.

2. Description of the Related Art

Recent color image forming apparatuses that use an electrophotographic technology and form an image forming system apply four color toners of yellow, magenta, cyan, and black to an electrostatic latent image which is obtained by irradiating an image bearing member with a laser beam modulated based on image data, thereby forming toner images. The toner images are transferred to various kinds of printing media (e.g., a PPC paper, OHP sheet, and thick paper; to be referred to as paper hereinafter) and then fused by, e.g., a heat roller. As a fixing unit to fix a toner image on paper, a roll fixing unit or belt fixing unit is employed.

To enhance the gloss of an image after fixing and obtain a fine-looking color image, an image forming apparatus adopts a method of designing an optimum toner viscoelastic characteristic, thereby improving the smoothness of the image after fixing. A full-color electrophotographic printer is used to output image data from a digital camera and is required to form a high-quality high-gloss image.

To meet this requirement, the image forming apparatus uses specialty paper which allows output in a high-gloss mode to obtain a highly glossy image as compared to paper (plain paper) used for normal output. The specialty paper used for output in the high-gloss mode has, on its surface, a transparent resin layer made of a thermoplastic resin. A color toner containing a thermoplastic resin is transferred to the paper surface with the transparent resin layer and heated and fused, thereby forming a high-gloss color image.

To obtain a high glossiness, the image forming apparatus must supply a large amount of heat to paper and toner and fuse the toner. To do this, the fixing speed of paper passing through the fixing unit is decreased to prolong the fixing time of the paper. However, when the fixing speed of paper decreases to prolong the fixing time, the productivity lowers. It is also necessary to decrease the fixing speed and prolong the fixing time in forming an image on specialty paper such as an OHP sheet or thick paper.

An image forming apparatus having a plurality of fixing units has been proposed to avoid the decrease in productivity. For example, Japanese Patent Laid-Open No. 2005-099759 describes an arrangement which has two fixing units with different fixing speeds and conveys paper even to the downstream low-speed belt fixing unit in the high-gloss mode. Japanese Patent Laid-Open No. 10-123863 describes an arrangement which juxtaposes two fixing units, one of which can change the speed for glossiness control.

For an image forming apparatus using one fixing unit, a technique of changing the job sequence has been proposed to avoid time loss and improve productivity. According to an arrangement described in, e.g., Japanese Patent Laid-Open No. 2005-010292, in a process using a plurality of image forming speeds in, e.g., a high-gloss mode, the job sequence is changed so that the images of high-speed jobs are formed at once, and those of low-speed jobs are then formed at once. Japanese Patent Laid-Open No. 2001-274999 describes an arrangement which changes the sequence of pages of image data containing both color and monochrome images in one job, forms the images of color pages at once, and makes them standby in an intermediate tray. Then, the apparatus forms the images of monochrome pages at once and discharges the paper sheets with the formed images in the order of pages.

However, in the above-described image forming apparatus having a plurality of fixing units, the productivity may greatly decrease in image formation of a job that designates an image forming mode using both plain paper and specialty paper such as an OHP sheet, thick paper, or paper having a transparent resin layer on the surface to form a high-gloss image.

More specifically, when output products (products obtained by outputting images onto specialty paper or plain paper) should be stacked on a single discharge unit, the discharged paper stacking sequence of the output products is taken into consideration. In image formation using specialty paper, the start of subsequent image formation must be delayed in consideration of the fixing time or fixing speed.

The reason for this will be described in detail with reference to FIG. 1. For example, assume that in a job for sequentially outputting six images shown in FIG. 1, images 1, 2, 4, and 6 are output to plain paper while images 3 and 5 are output to specialty paper. The two fixing units have different fixing speeds (or fixing times) to cope with plain paper and specialty paper. The fixing speed of the fixing unit for specialty paper is lower than that of the fixing unit for plain paper. Even when the two fixing units are used, fixing on specialty paper takes a longer time than fixing on plain paper. Hence, to output the six images in the order of images 1, 2, 3, 4, 5, and 6, a wait time is necessary before image 4, as shown in FIG. 1, to output image 4 next to image 3. This also applies to image 5. A wait time is necessary before image 6 to output image 6 next to image 5.

For this reason, in a job using both specialty paper and plain paper, if the number of specialty paper sheets increases, the wait time becomes long. Consequently, the productivity of the image forming apparatus decreases.

SUMMARY OF THE INVENTION

The present invention provides an image forming system capable of discharging paper sheets onto a single discharge unit in a designated output product stacking sequence while avoiding a decrease in productivity that occurs when the fixing speed of a fixing unit for fixing a specialty image is lower than that of a fixing unit for fixing a plain image.

According to one aspect of the present invention, there is provided an image forming system comprising an image forming unit adapted to form an image as a toner image on a printing medium, a first fixing unit adapted to fix, on the printing medium, the toner image formed by the image forming unit, a second fixing unit arranged at a position different from the first fixing unit and used when a larger amount of heat is necessary for fixing the toner image on the printing medium, and a changing unit adapted to change a sequence of image formation by the image forming unit when the second fixing unit is used during image formation.

According to another aspect of the present invention, there is provided a control method of an image forming system, comprising the steps of forming an image as a toner image on a printing medium, performing first fixing to fix, on the printing medium, the toner image formed in the image forming step, performing second fixing to fix the toner image on the printing medium when a larger amount of heat is necessary for fixing the toner image on the printing medium, and changing a sequence of image formation in the image forming step when the second fixing step is executed during image formation.

Further features of the present invention will become apparent from the following description of exemplary embodiments with reference to the attached drawings.

BRIEF DESCRIPTION OF THE DRAWINGS

FIG. 3C is a view showing an example of a job.

DESCRIPTION OF THE EMBODIMENTS

First Embodiment

[Features]

Figure 1:
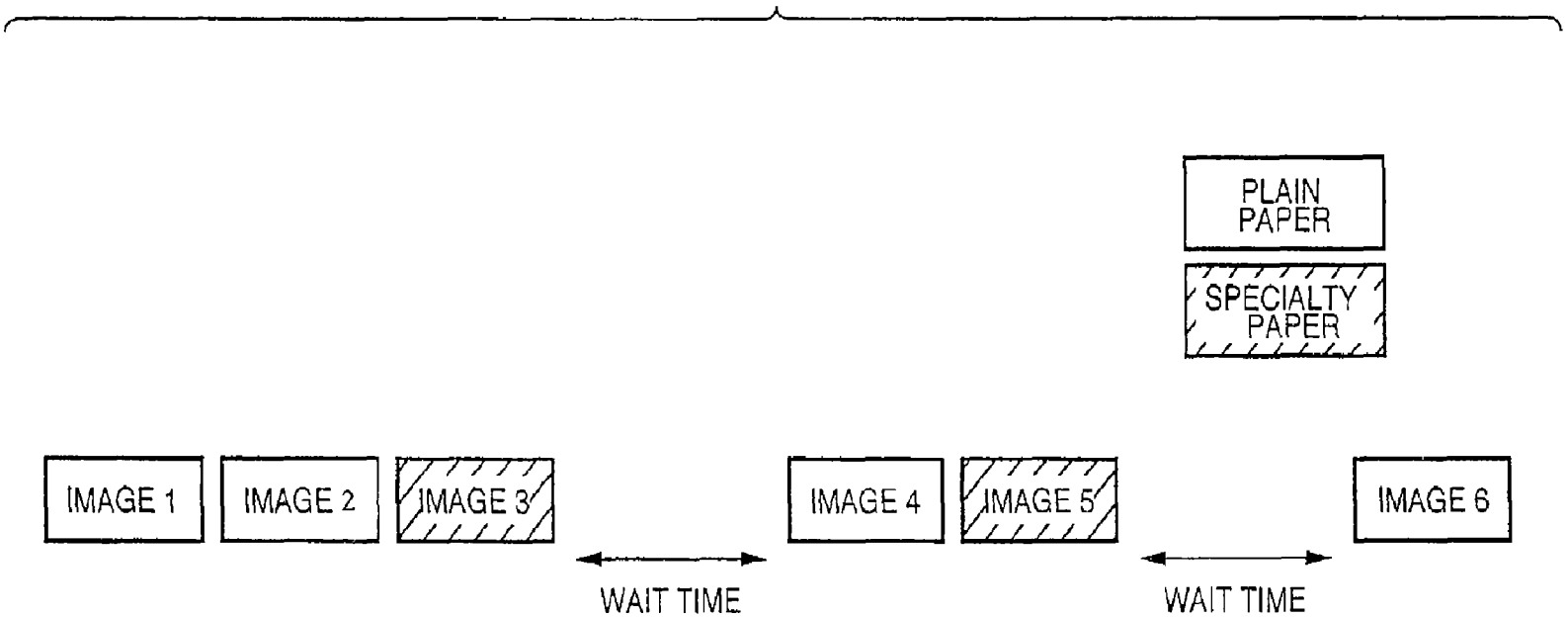
FIG. 1 is a view for explaining a problem of wait time in a fixing step for a job using both specialty paper and plain paper.

An image forming system of the present invention can discharge paper sheets onto a single discharge unit in a designated output product staking sequence while avoiding a decrease in output productivity when the fixing speed of a fixing device for fixing a specialty image is lower than that of a fixing device for fixing a plain image, i.e., when the amount of heat (temperature) required for fixing a specialty image is larger (higher) than that required for fixing a plain image in an image forming job (mixed job) for executing image formation described with reference to FIG. 1. The image forming system of the present invention determines the size of a printing medium to be used and the type of a toner image (plain image/specialty image) to be formed on the printing medium in outputting an image forming job for image formation. A plain image is an image formed on plain paper, and a specialty image is an image formed on specialty paper. If it is determined that a plurality of images (mixed: plain images+specialty images) are to be formed, the image forming system of the present invention can set an image forming sequence and a wait time in image formation to minimize the toner image fixing time without changing the image output sequence. It is therefore possible to improve the output productivity of a job (mixed job) containing specialty images that take a longer fixing time than plain images by optimizing the image forming sequence by, e.g., placing the timing of specialty image formation before the timing of plain image output.

The image forming system of the present invention will be described below in detail with reference to the accompanying drawings.

Figure 2A:
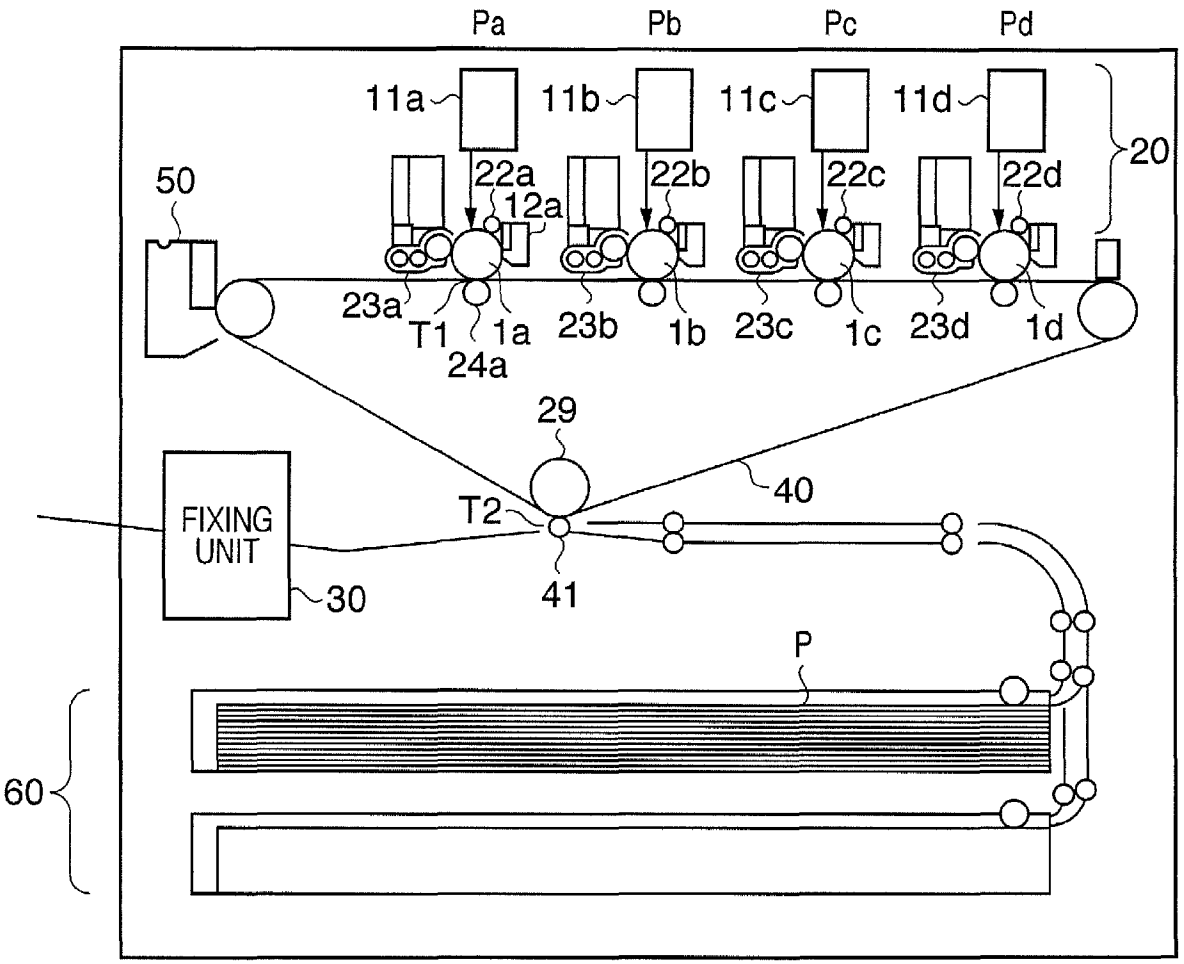
FIG. 2A is a schematic sectional view showing the arrangement of an image forming apparatus according to the first embodiment of the present invention.

[Image Forming System: FIG. 2A]

FIG. 2A is a sectional view of a color image forming apparatus serving as one component of the image forming system according to the first embodiment.

The color image forming apparatus includes an image forming unit 20, fixing unit 30 having two fixing devices, intermediate transfer unit 40, cleaning unit 50, paper feed unit 60, display unit (not shown), input unit (not shown), and control unit (not shown). In the image forming unit 20, four image forming stations Pa, Pb, Pc, and Pd are juxtaposed. The four image forming stations Pa, Pb, Pc, and Pd have identical arrangements. The arrangements of the units will be described below.

Photosensitive drums 1*a*, 1*b*, 1*c*, and 1*d* each serving as a photoconductor are rotated clockwise at a predetermined peripheral velocity (process speed). Primary chargers 22*a*, 22*b*, 22*c*, and 22*d* uniformly charge the photosensitive drums 1*a*, 1*b*, 1*c*, and 1*d* to a predetermined polarity and potential.

Image exposure units 11*a*, 11*b*, 11*c*, and 11*d* execute image exposure to form electrostatic latent images corresponding to the respective color components (e.g., yellow color component) of a color image on the photosensitive drums 1*a*, 1*b*, 1*c*, and 1*d*. Each of the image exposure units 11*a*, 11*b*, 11*c*, and 11*d* includes an imaging exposure optical system and a scanning exposure system including a laser scanner which outputs a laser beam modulated in correspondence with a time-series electrical digital pixel signal of image information.

A first developing device (black developing device) 23*a* develops one of the electrostatic latent images by the first color, i.e., a black toner K. Similarly, a second developing device (yellow developing device) 23*b*, third developing device (magenta developing device) 23*c*, and fourth developing device (cyan developing device) 23*d* operate and develop the remaining electrostatic latent image to yellow, magenta, and cyan, respectively.

The intermediate transfer unit 40 is an intermediate transfer belt that is rotated clockwise at the same peripheral velocity as the photosensitive drums 1*a* to 1*d*. The toner image formed on the photosensitive drum 1*a* and developed by the black toner K of the first color passes through a nip T1 between the photosensitive drum 1*a* and the intermediate transfer unit 40. In this process, a first transfer bias applied from a primary transfer roller 24*a* to the intermediate transfer unit 40 sequentially primarily transfers the toner image to the outer surface of the intermediate transfer unit 40.

A cleaning unit 12*a* cleans the surface of the photosensitive drum 1*a* after transferring the toner image to the intermediate transfer unit 40.

In a similar manner, the toner image developed by the yellow toner of the second color, the toner image developed by the magenta toner of the third color, and the toner image developed by the cyan toner of the fourth color are sequentially transferred from the photosensitive drums 1*b* to 1*d* to the intermediate transfer unit 40 and superimposed. As a result, a color toner image corresponding to the color image is formed on the intermediate transfer unit 40. The cleaning unit 50 cleans the surface of the intermediate transfer unit 40 after transferring the color toner image.

A secondary transfer roller 41 is supported by bearings in parallel to a secondary transfer counter roller 29 and placed on the lower side of the intermediate transfer unit 40.

The primary transfer bias to sequentially transfer the toner images of the first to fourth colors from the photosensitive drums 1*a* to 1*d* to the intermediate transfer unit 40 in a superimposed manner is applied at a polarity (+) opposite to the toners. The applied voltage ranges from, e.g., +100 V to 2 kV.

To transfer the color toner image transferred to the intermediate transfer unit 40 to a paper sheet P, the secondary transfer roller 41 abuts against the intermediate transfer unit 40. On the other hand, the paper sheet P is supplied from the paper feed unit 60 to a butt nip T2 between the intermediate transfer unit 40 and the secondary transfer roller 41 through a transfer material guide. A secondary transfer bias is applied to the secondary transfer roller 41. The secondary transfer bias secondarily transfers the color toner image from the intermediate transfer unit 40 to the paper sheet P. The paper sheet P having the transferred color toner image enters the fixing unit 30 and undergoes heat fixing.

Figure 2B:
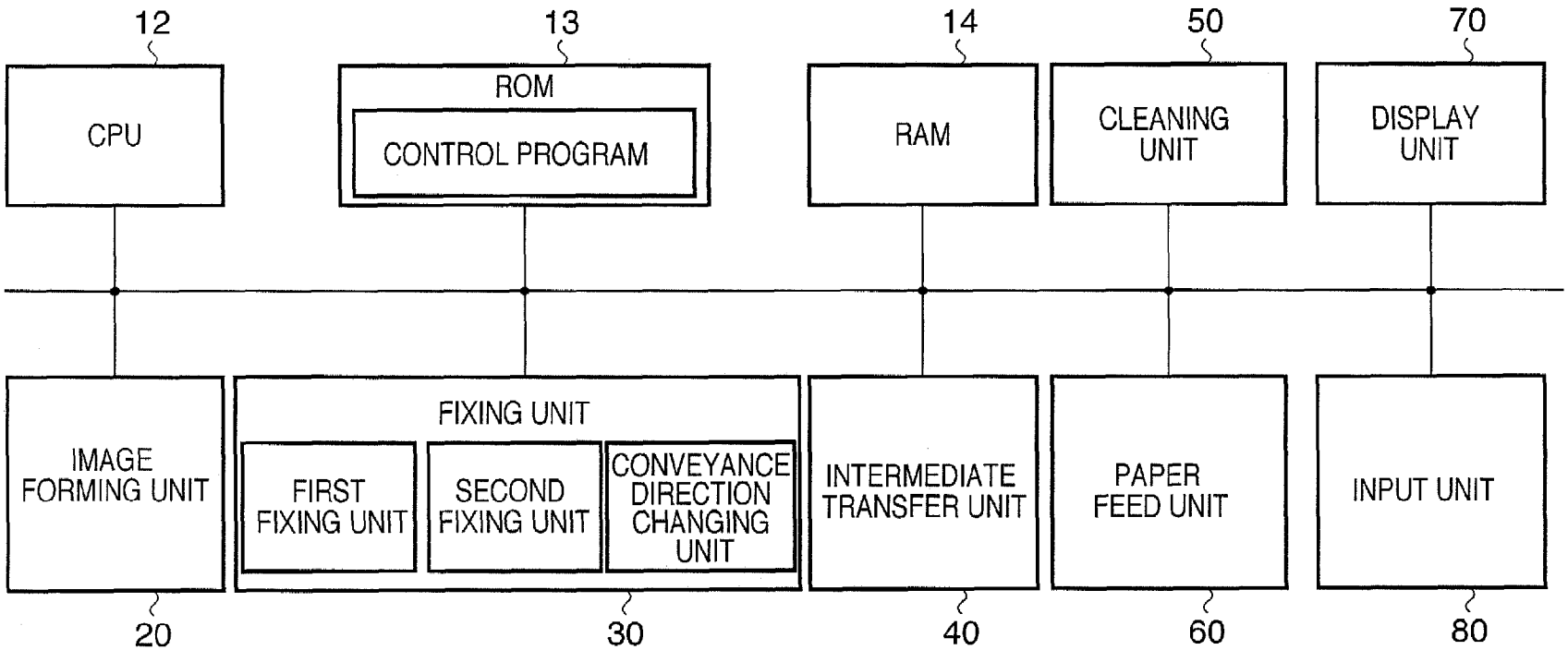
FIG. 2B is a block diagram showing an example of control configuration of an image forming system.

[Control Configuration of Image Forming System: FIG. 2B]

The control configuration of the above-described image forming system will be described next with reference to FIG. 2B.

The control unit includes a CPU 12, ROM 13, and RAM 14. The control unit controls the respective units including the image forming unit 20, paper feed unit 60, intermediate transfer unit 40, fixing unit 30, cleaning unit 50, display unit 70, and input unit 80. The CPU 12 of the control unit controls the respective units based on a control program stored in the ROM 13 using the RAM 14 as a work area and optimizes the image forming sequence by, e.g., placing the timing of specialty image formation before the timing of plain image output (to be described below). The CPU 12, ROM 13, and RAM 14 for the process of optimizing the image forming sequence may be provided in the image forming apparatus or an external device such as a scanner, host computer, or server serving as one component of the image forming system.

Figure 2C:
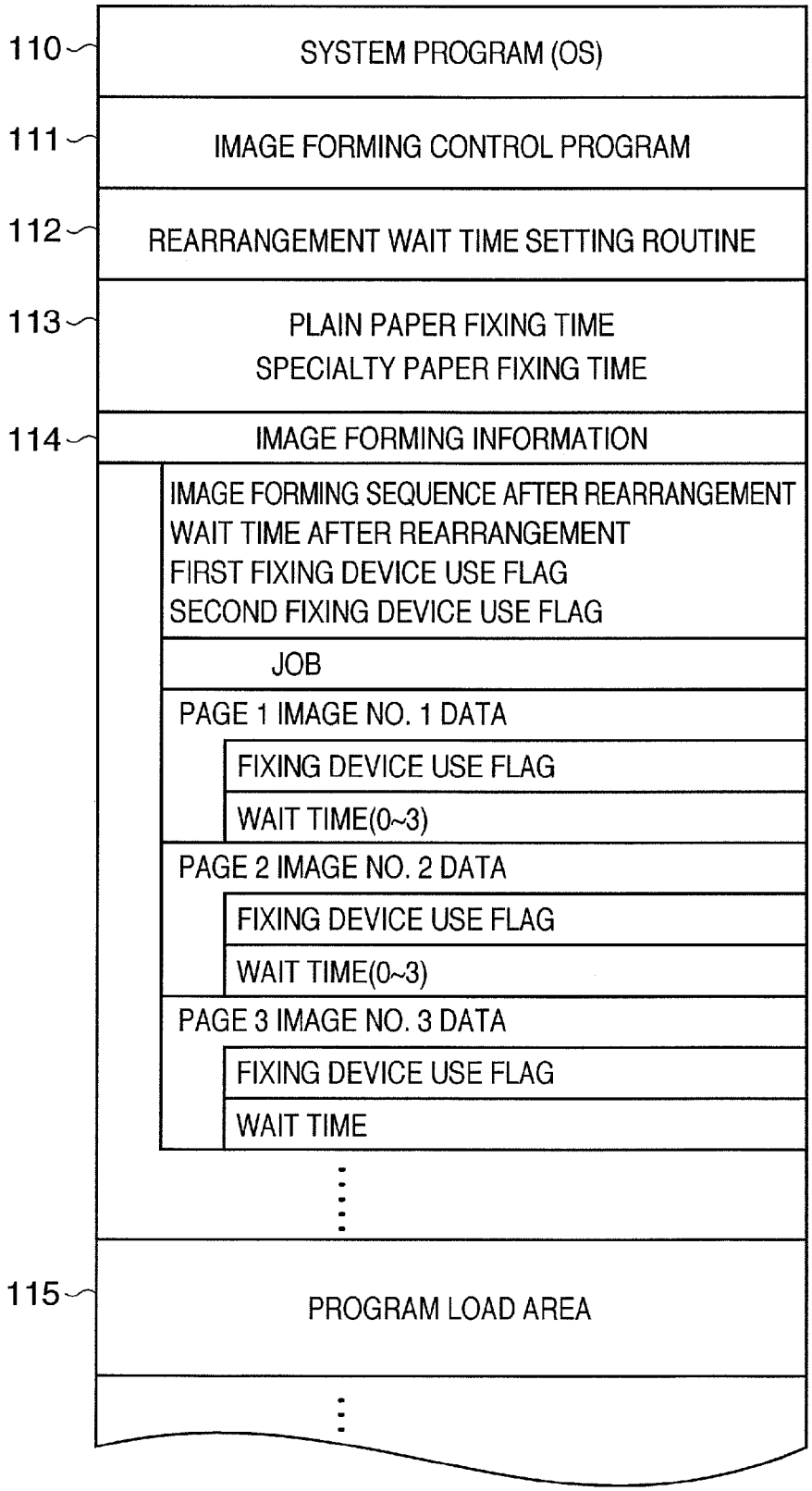
FIG. 2C is a view for explaining an example of contents stored in a ROM/RAM.

[Arrangement of ROM/RAM: FIG. 2C]

An arrangement example of the ROM 13 and RAM 14 will be described next with reference to FIG. 2C.

Each of the ROM 13 and RAM 14 includes a system program 110, image forming control program 111, rearrangement wait time setting routine 112, plain paper/specialty paper fixing time 113, image forming information 114, and program load area 115. The image forming information 114 contains an image forming sequence after rearrangement, wait time (adjustment time) to adjust the image forming time after rearrangement, first fixing device use flag, second fixing device use flag, and job.

The job contains image data, fixing device use flag, and wait time (0 to 3) of each page.

Figure 3A:
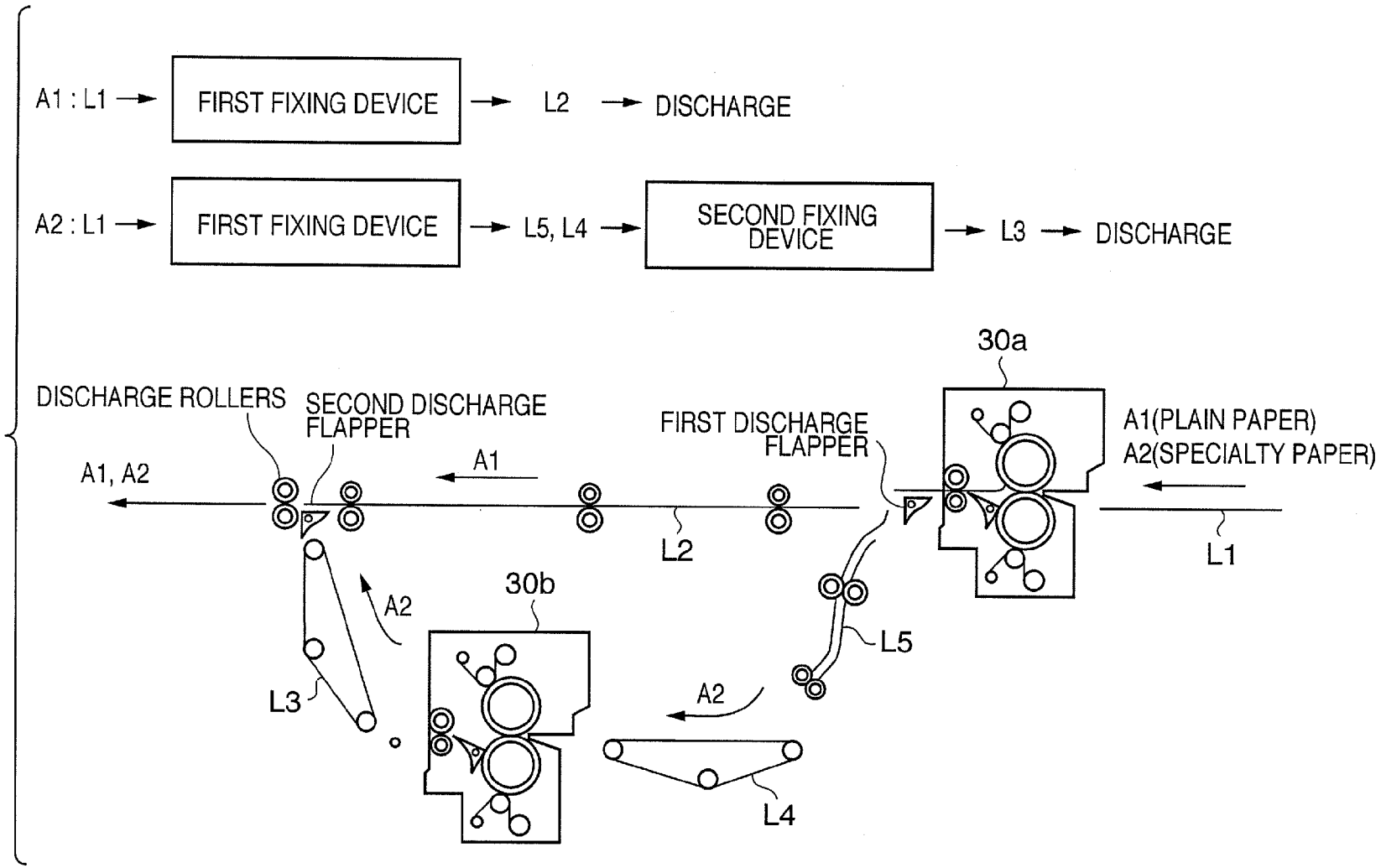
FIG. 3A is a schematic view showing an arrangement of fixing devices.

[Arrangement of Fixing Unit: FIG. 3A]

An arrangement example of the fixing unit 30 will be described next with reference to FIG. 3A.

The fixing unit 30 shown in FIG. 3A has two fixing devices (first fixing device 30*a* and second fixing device 30*b*) arranged as shown in FIG. 3A. The first fixing device 30*a* is used to fix a toner image transferred to plain paper A1. The plain paper A1 having the image fixed by the first fixing device 30*a* is discharged through discharge rollers. The route is conveyance path L1→first fixing device 30*a*→first discharge flapper→conveyance path L2→second discharge flapper (discharge side).

The second fixing device 30*b* is used to fix a toner image transferred to specialty paper (high-gloss paper with a transparent resin layer, OHP sheet, or thick paper) A2. The specialty paper A2 having the image fixed by the second fixing device 30*b* is discharged through the discharge rollers. The route is conveyance path L1→first fixing device 30*a*→first discharge flapper→conveyance path L5→conveyance path L4→second fixing device 30*b*→conveyance path L3→second discharge flapper (discharge side). The second fixing device 30*b* conveys the specialty paper A2 at a low fixing speed to raise the fixing temperature (supply a large amount of heat) as compared to the first fixing device 30*a*. When the second fixing device 30*b* is used, the specialty paper A2 is preheated by the first fixing device 30*a* and then subjected to fixing by the second fixing device 30*b*.

In the fixing unit 30 shown in FIG. 3A, the first fixing device 30*a* and second fixing device 30*b* have identical structures and obtain different fixing temperatures by changing the fixing speed (the fixing temperature is raised by reducing the fixing speed). If the first fixing device 30*a* and second fixing device 30*b* have different structures, a desired fixing temperature is obtained by changing the fixing time.

Figure 3B:
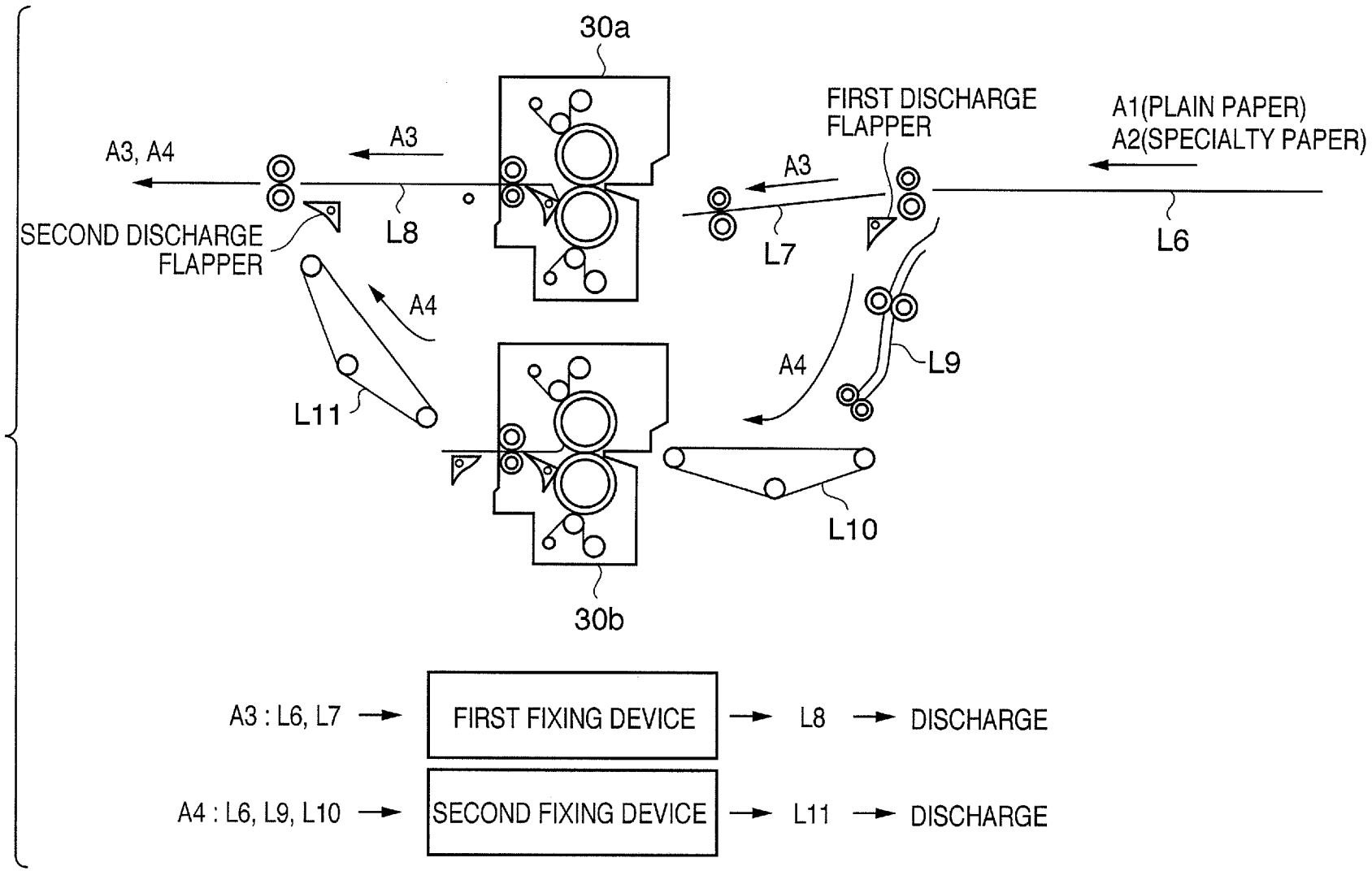
FIG. 3B is a schematic view showing another arrangement of the fixing devices.

[Another Arrangement of Fixing Unit: FIG. 3B]

FIG. 3B is a view showing another arrangement of the fixing unit 30.

The fixing unit 30 shown in FIG. 3B has the first fixing device 30*a* and second fixing device 30*b* arranged as shown in FIG. 3B. The first fixing device 30*a* is used to fix a toner image transferred to the plain paper A1. The plain paper A1 having the image fixed by the first fixing device 30*a* is discharged through the discharge rollers. The route is conveyance path L6→first discharge flapper→conveyance path L7→first fixing device 30*a*→second discharge flapper (discharge side).

The second fixing device 30*b* is used to fix a toner image transferred to the specialty paper (high-gloss paper with a transparent resin layer, OHP sheet, or thick paper) A2. The specialty paper A2 having the image fixed by the second fixing device 30*b* is discharged through the discharge rollers. The second fixing device 30*b* conveys the specialty paper A2 at a low fixing speed to raise the fixing temperature (supply a large amount of heat) as compared to the first fixing device 30*a*. The route is conveyance path L6→first discharge flapper→conveyance path L9→conveyance path L10→second fixing device 30*b*→conveyance path L11→second discharge flapper (discharge side).

In the fixing unit 30 shown in FIG. 3B, the first fixing device 30*a* and second fixing device 30*b* have identical structures and obtain different fixing temperatures by changing the fixing speed (the fixing temperature is raised by reducing the fixing speed). If the first fixing device 30*a* and second fixing device 30*b* have different structures, a desired fixing temperature is obtained by changing the fixing time.

The conveyance route of the above-described fixing unit 30 will be explained next.

The conveyance paths L3, L4, and L5 in the fixing unit 30 shown in FIG. 3A or the conveyance paths L9, L10, and L11 of the fixing unit 30 shown in FIG. 3B are determined depending on the size of the specialty paper A2. In the fixing unit 30 shown in FIG. 3A, the conveyance path L4 decelerates specialty paper conveyed at the speed of plain paper before the entrance of the second fixing device 30*b* and sends it to the second fixing device 30*b*. The conveyance path L3 on the discharge side of the second fixing device 30*b* accelerates the specialty paper to the conveyance speed of plain paper. If the fixing speed of the second fixing device 30*b* is different from that of the first fixing device 30*a*, a conveyance unit to increase/decrease the paper conveyance speed is necessary. The conveyance unit has a function of preventing a paper sheet from looping due to the speed difference between its leading edge and trailing edge. Hence, the conveyance paths L3 to L5 preferably have a length equal to or more than the maximum paper size.

For example, a case wherein fixing is executed on plain paper and specialty paper with A3 size (420 mm×297 mm) will be described with reference to FIG. 3A. Assume that the first fixing device 30*a* for plain paper has a first fixing speed (300 mm/s, paper passage time: 1.4 sec/A3), and the second fixing device 30*b* for specialty paper has a second fixing speed (50 mm/s, paper passage time: 8.4 sec/A3). In this case, the specialty paper needs to accelerate from the first fixing speed to the second fixing speed before the second fixing device 30*b* and then decelerate from the second fixing speed to the first fixing speed after the second fixing device 30*b*. Considering the size of the passing specialty paper, it is necessary to provide the conveyance paths L5, L4, and L3 for deceleration and acceleration before and after the second fixing device 30*b*.

[Process of Job Using Both Plain Paper and Specialty Paper]

An image forming process of a job (mixed job) using paper sheets (plain paper/specialty paper) with different image forming conditions, as shown in FIG. 3C, in the image forming system of the present invention will be described next in detail with reference to FIGS. 4A to 6B.

[Example of Job (Mixed Job): FIG. 3C]

FIG. 3C is a view showing an example of a job (mixed job) received from an external device (information generation unit) such as a host computer, server, or scanner. In the job shown in FIG. 3C, the number of print pages is five, and the pages are output in a sequence of pages 1, 2, 3, 4, and 5, the paper size is A3, and both plain paper and specialty paper are used. The image forming conditions set for pages 1, 2, 4, and 5 indicate that the images are formed on plain paper by using the first fixing device 30*a*. The image forming conditions set for page 3 indicate that the image is formed on specialty paper by using the second fixing device 30*b*.

Figure 4A:
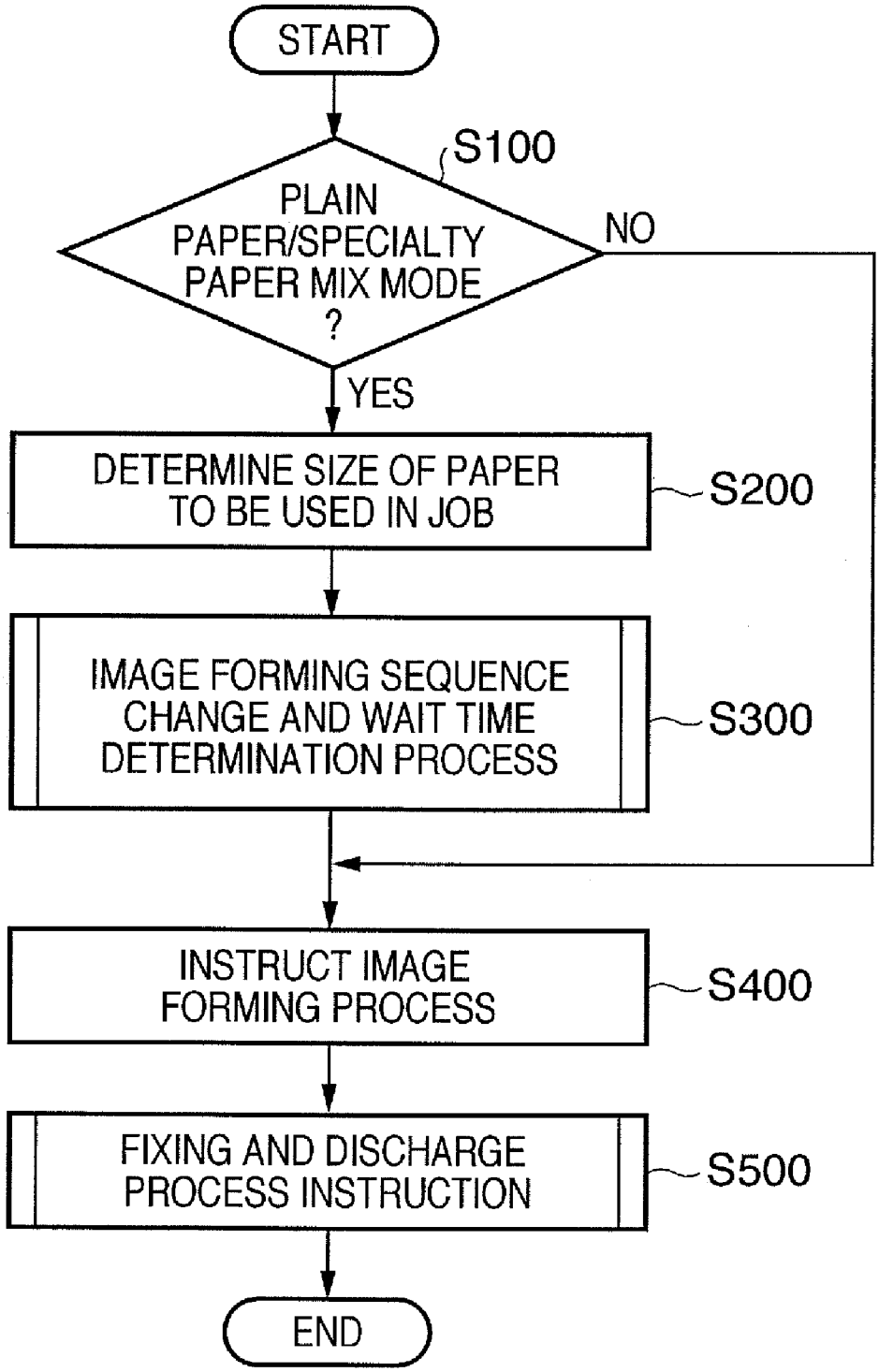
FIG. 4A is a flowchart illustrating an example of a process of changing the image forming sequence and printing a job using both plain paper and specialty paper.

[Process of Setting Image Forming Sequence and Wait Time of Job (Mixed Job): FIG. 4A]

The image forming system of the present invention receives the job shown in FIG. 3C and temporarily holds the rasterized image in the RAM 14. The image forming sequence is changed to increase the productivity, as show in FIG. 4A. The CPU 12 of the control unit executes the process shown in FIG. 4A while controlling the respective units based on the control program stored in the ROM 13 by using the RAM 14 as a work area. With this process, the image forming sequence is set such that the total fixing time of plain paper and specialty paper is minimized. Additionally, the wait time during image formation is set such that the plain paper and specialty paper after fixing are stacked on a single discharge unit in a correct page sequence. Hence, the image forming system of the present invention can quickly output a job and increase the whole productivity.

Referring to FIG. 4A, in step S100, the CPU 12 determines whether the job has a mix mode to use both plain paper and specialty paper. If the CPU 12 determines the mode as the mix mode, the process advances to step S200 to determine the size of paper used in the job. Based on the size of paper used in the job, the CPU 12 sets the positional relationship between plain paper and specialty paper in the fixing devices.

The CPU 12 sets the relationship between a fixing time B or count B of specialty paper to be discharged through the first fixing device 30*a* and second fixing device 30*b* in FIG. 3A and a fixing time A or count A of plain paper until discharge from the first fixing device 30*a* to a predetermined relationship. The number of sheets of plain paper that can undergo fixing by the first fixing device 30*a* in parallel to fixing on specialty paper by the second fixing device 30*b* is determined based on the set predetermined relationship. The predetermined relationship is determined depending on the paper size, conveyance path length, and speed. Hence, the predetermined relationship has a value unique to the apparatus and can arbitrary be set within a range determined by the paper size, conveyance path length, and speed. In this embodiment, when the paper size is A3, the predetermined relationship is set to count A:count B=less than 3:1. When the paper size is A4, the predetermined relationship is set to count A:count B=less than 6:2.

The predetermined relationship indicates that two sheets of plain paper A1 are discharged from the first fixing device 30*a* in a time necessary for discharging one sheet of specialty paper A2 through the first fixing device 30*a* and second fixing device 30*b*. If the predetermined relationship is satisfied, the first fixing device 30*a* can execute fixing on two sheets of plain paper A1 while the second fixing device 30*b* is executing fixing on one sheet of specialty paper. Hence, if the predetermined relationship is satisfied, the third process of outputting the specialty paper in FIG. 3C can change to the first image forming process. In other words, a page in the mode to form an image at a low fixing speed precedes in consideration of the delay time in the plurality of fixing devices with different fixing speeds. As described above, when the paper size is A3, the predetermined relationship is set to count A:count B=less than 3:1. Hence, the images in the job are rearranged within three images.

The process advances to step S300. The CPU 12 changes the image forming sequence and determines the wait time. If the CPU 12 determines in step S100 that the mode is not the mix mode, i.e., that a mode to use only plain paper or specialty paper is set, the process advances to step S400.

In step S400, the CPU 12 issues an image forming process instruction. In step S500, the CPU 12 issues a fixing and discharge process instruction, and the series of processes finishes.

Figure 4B:
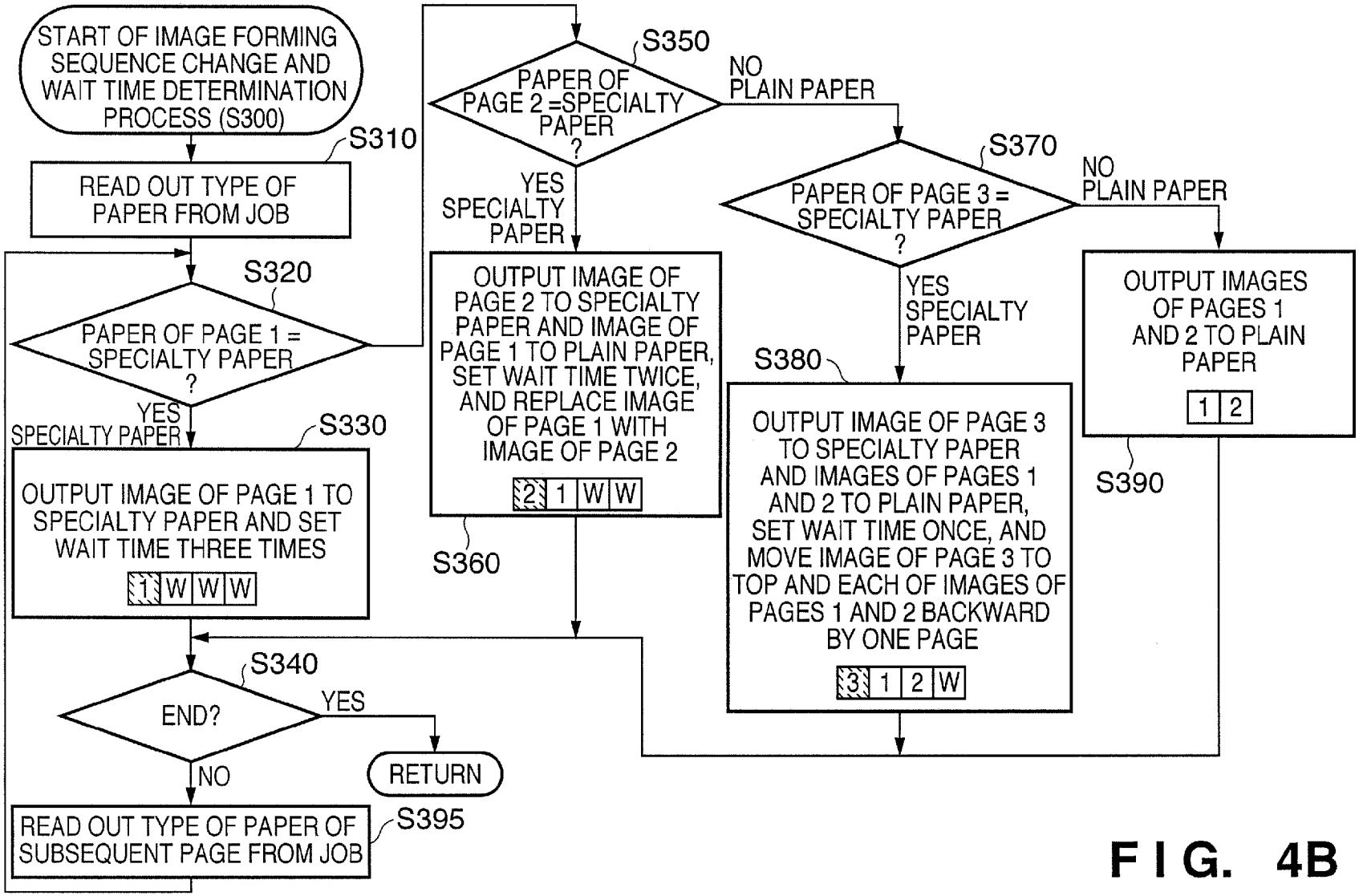
FIG. 4B is a flowchart illustrating an example of a detailed process of changing the image forming sequence and determining the wait time.

[Image Forming Sequence Change and Wait Time Determination Process: FIG. 4B]

The process in step S300 in FIG. 4A will be described in detail with reference to FIG. 4B.

In step S310, the CPU 12 reads out, from the job, the type of paper (plain paper/specialty paper) to be used.

In step S320, the CPU 12 determines whether the paper sheet of page 1 of the job is specialty paper or plain paper. If the paper sheet of page 1 is specialty paper, the process advances to step S330 to output the image of page 1 to specialty paper and set the wait time three times (wait time Δt is a predetermined time). Then, the process advances to step S340. More specifically, without changing the image sequence, the image of page 1 is output (1=output to specialty paper), and the wait time is set three times, as shown in FIG. 4B.

If it is determined in step S320 that the paper sheet of page 1 is plain paper, the process advances to step S350. The CPU 12 determines whether the paper sheet of page 2 is specialty paper or plain paper. If the paper sheet of page 2 is specialty paper, the process advances to step S360. The CPU 12 replaces the image of page 1 with the image of page 2, outputs the image of page 2 to specialty paper and the image of page 1 to plain paper, and sets the wait time twice. Then, the process advances to step S340. More specifically, the image of page 2 is output (2=output to specialty paper), the image of page 1 is output (1=output to plain paper), and the wait time is set twice, as shown in FIG. 4B.

If it is determined in step S350 that the paper sheet of page 2 is plain paper, the process advances to step S370. The CPU 12 determines whether the paper sheet of page 3 is specialty paper or plain paper. If the paper sheet of page 3 is specialty paper, the process advances to step S380. The CPU 12 moves the image of page 3 to the top and each of the images of pages 1 and 2 backward by one page. The CPU 12 outputs the image of page 3 to specialty paper and the images of pages 1 and 2 to plain paper and sets the wait time once. Then, the process advances to step S340. More specifically, the image of page 3 is output (3=output to specialty paper), the images of pages 1 and 2 are output (1, 2=output to plain paper), and the wait time is set once, as shown in FIG. 4B.

If it is determined in step S370 that the paper sheet of page 3 is plain paper, the process advances to step S390. The CPU 12 outputs the images of pages 1 and 2 to plain paper and sets the wait time to 0. Then, the process advances to step S340. More specifically, without changing the image sequence, the images of pages 1 and 2 are output (1, 2=output to plain paper), and the wait time is set to 0, as shown in FIG. 4B.

In step S340, the CPU 12 checks whether paper determination is ended. If NO in step S340, the process advances to step S395 to read out the type of paper of the subsequent page from the job. The process returns to step S320 to repeat the above-described process. In this case, pages 1, 2, and 3 in steps S320, S350, and S370 sequentially change to succeeding page numbers.

If paper determination is ended in step S340, the series of operations finishes.

Figure 4C:
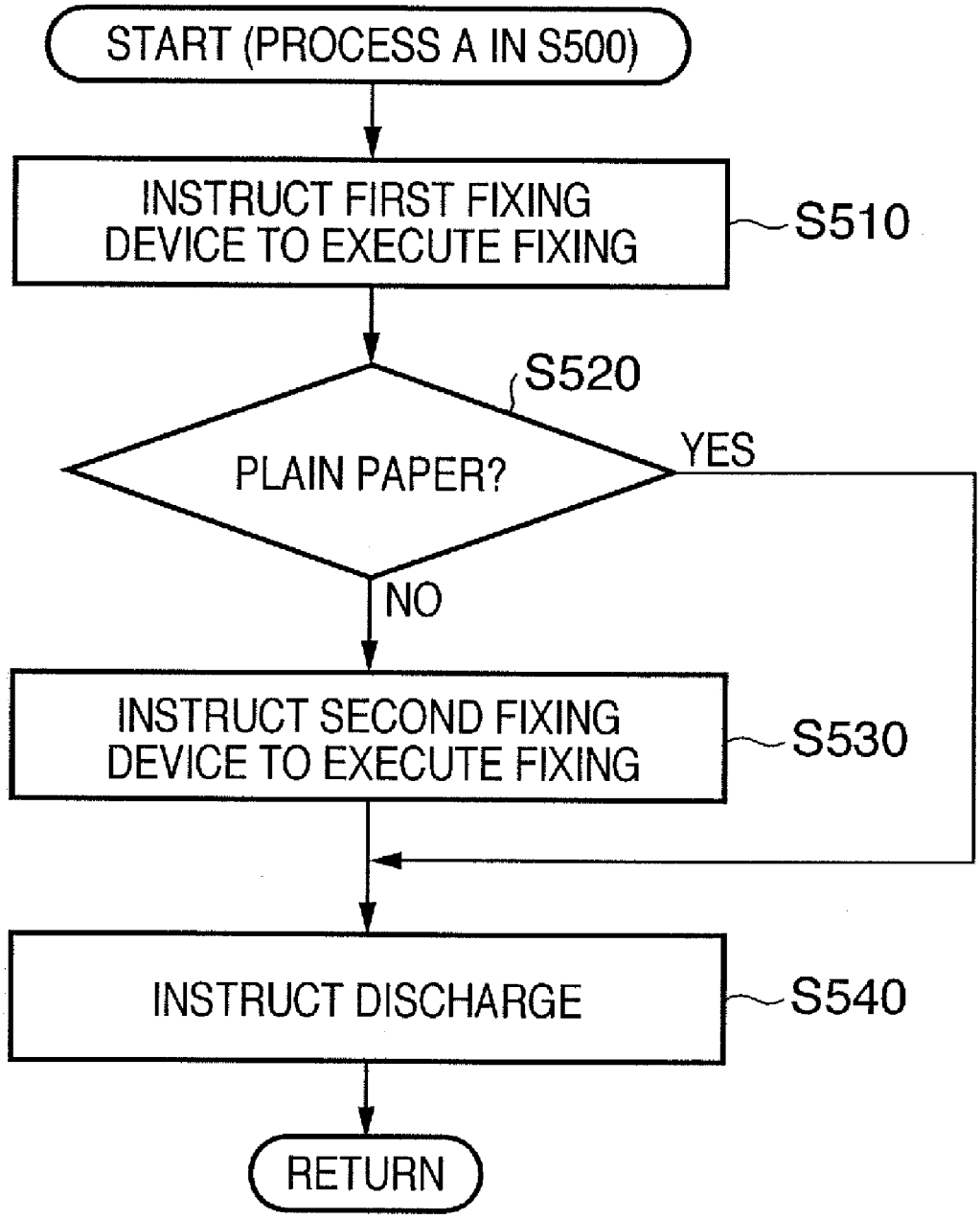
FIG. 4C is a flowchart illustrating an example of a process of causing two fixing devices to do fixing.

[Fixing and Discharge Process: FIG. 4C]

The process in step S500 in FIG. 4A will be described next in detail with reference to FIG. 4C. The process shown in FIG. 4C is executed when the fixing unit 30 shown in FIG. 3A is used.

In step S510, the CPU 12 instructs the first fixing device 30*a* to execute fixing. The process advances to step S520. In step S520, the CPU 12 determines whether the paper is plain paper or specialty paper. If the paper is specialty paper, the process advances to step S530 to instruct the second fixing device 30*b* to execute fixing. The process advances to step S540 to instruct discharge, and the series of operations finishes.

If the paper is plain paper in step S520, the process advances to step S540. The CPU 12 instructs discharge, and the series of operations finishes.

Figure 4D:
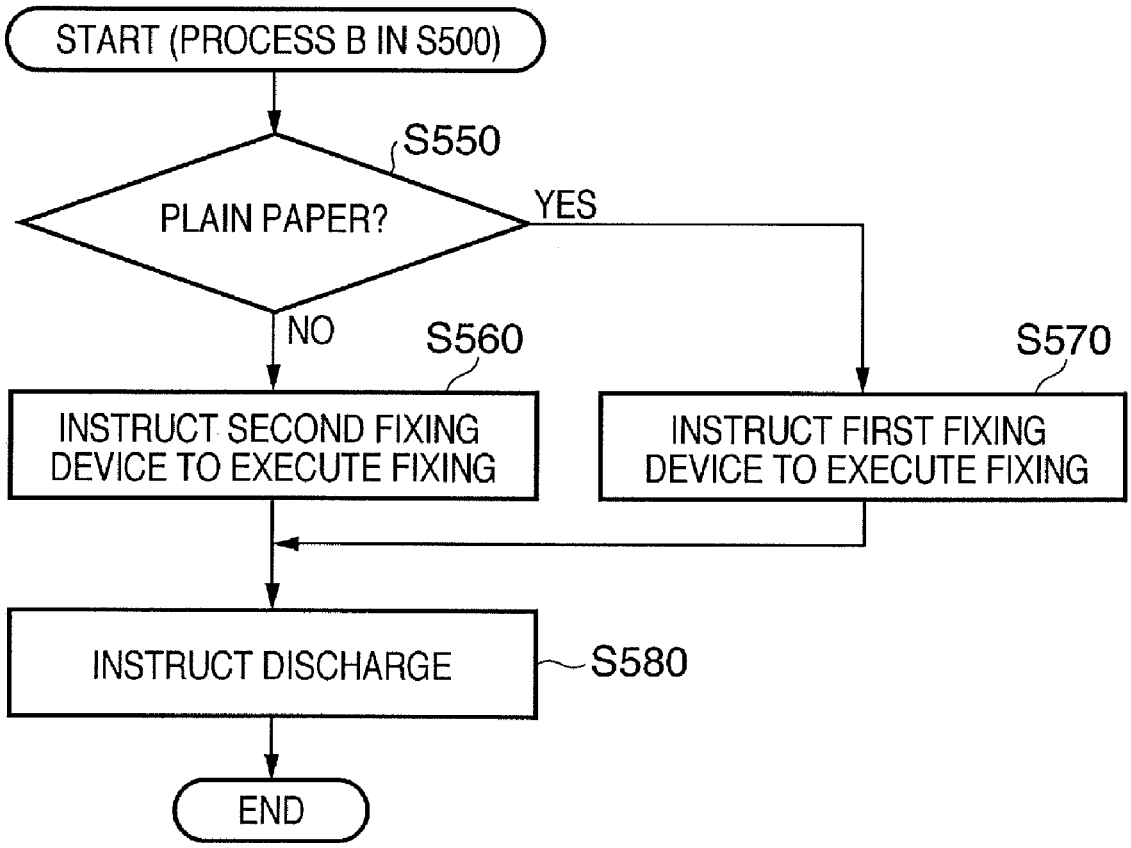
FIG. 4D is a flowchart illustrating an example of a process of causing two fixing devices connected in parallel to do fixing.

[Fixing and Discharge Process: FIG. 4D]

The process in step S500 in FIG. 4A will be described next in detail with reference to FIG. 4D. The process shown in FIG. 4D is executed when the fixing unit 30 shown in FIG. 3B is used.

In step S550, the CPU 12 determines whether the paper to be used is plain paper or specialty paper. If the paper to be used is specialty paper, the process advances to step S560. The CPU 12 instructs the second fixing device 30*b* to execute fixing. The process advances to step S580 to instruct discharge, and the series of operations finishes.

If the paper to be used is plain paper in step S550, the process advances to step S570. The CPU 12 instructs the first fixing device 30*a* to execute fixing. The process advances to step S580 to instruct discharge, and the series of operations finishes.

In this embodiment, the fixing time is determined sequentially from the top of the job. However, the fixing sequence and wait time corresponding to five output pages may be determined at once based on the entire pattern. To do this, e.g., a ROM table is usable.

[Detailed Examples of Image Forming Sequence Change Process]

Figure 5A:
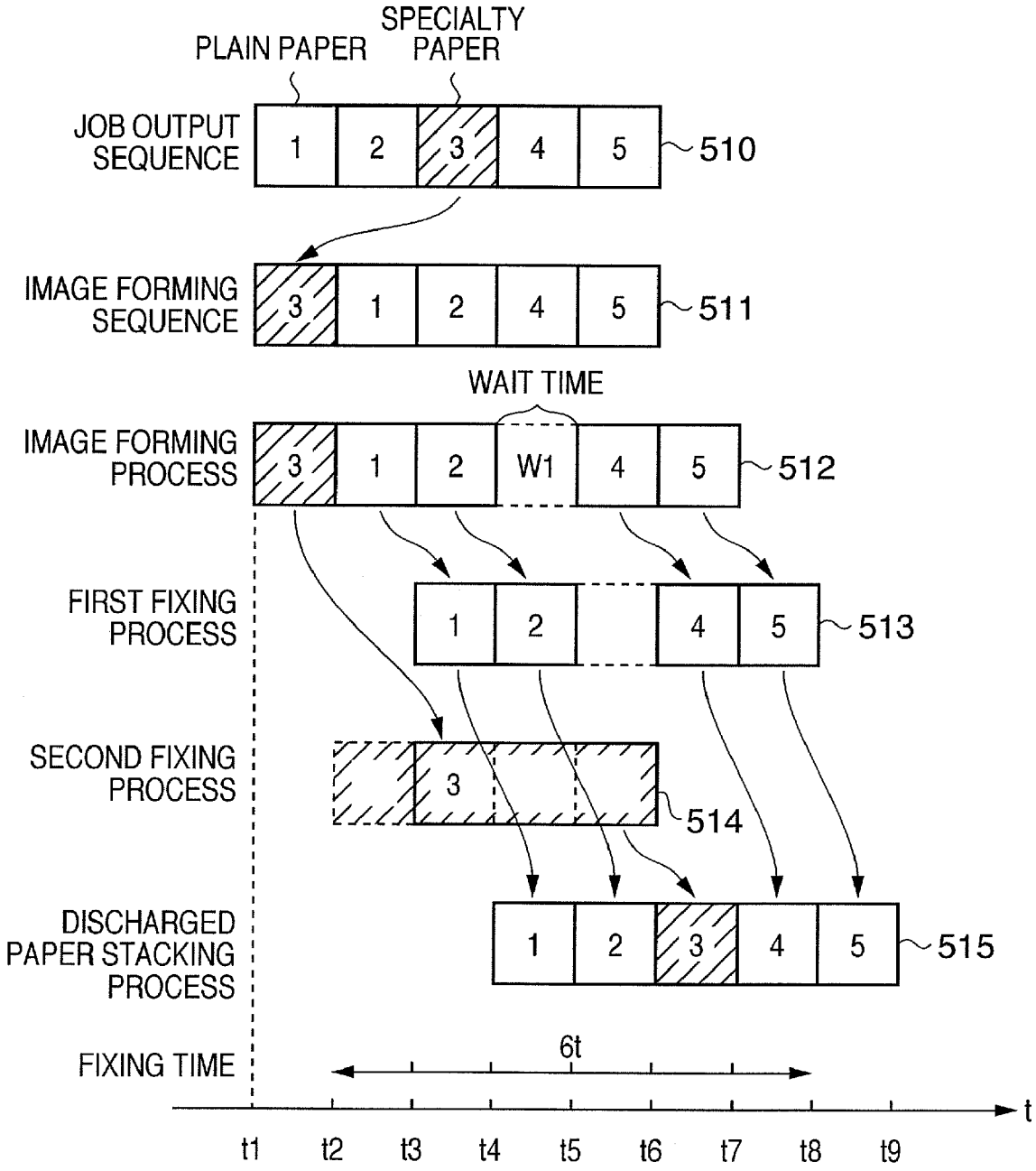
FIG. 5A is a view for explaining an image forming sequence change process and fixing time for a mixed job 510.
Figure 5B:
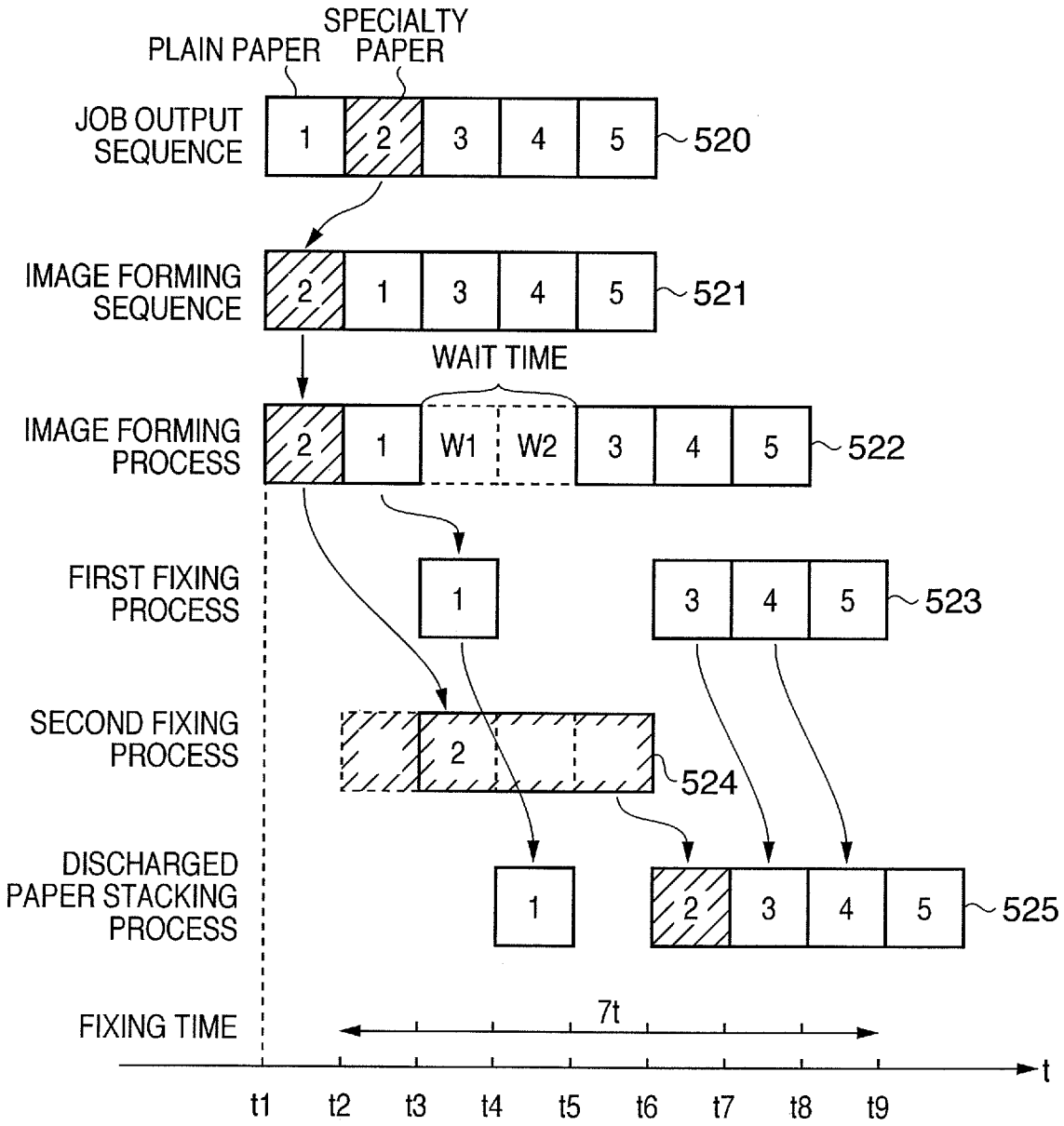
FIG. 5B is a view for explaining an image forming sequence change process and fixing time for a mixed job 520.
Figure 5C:
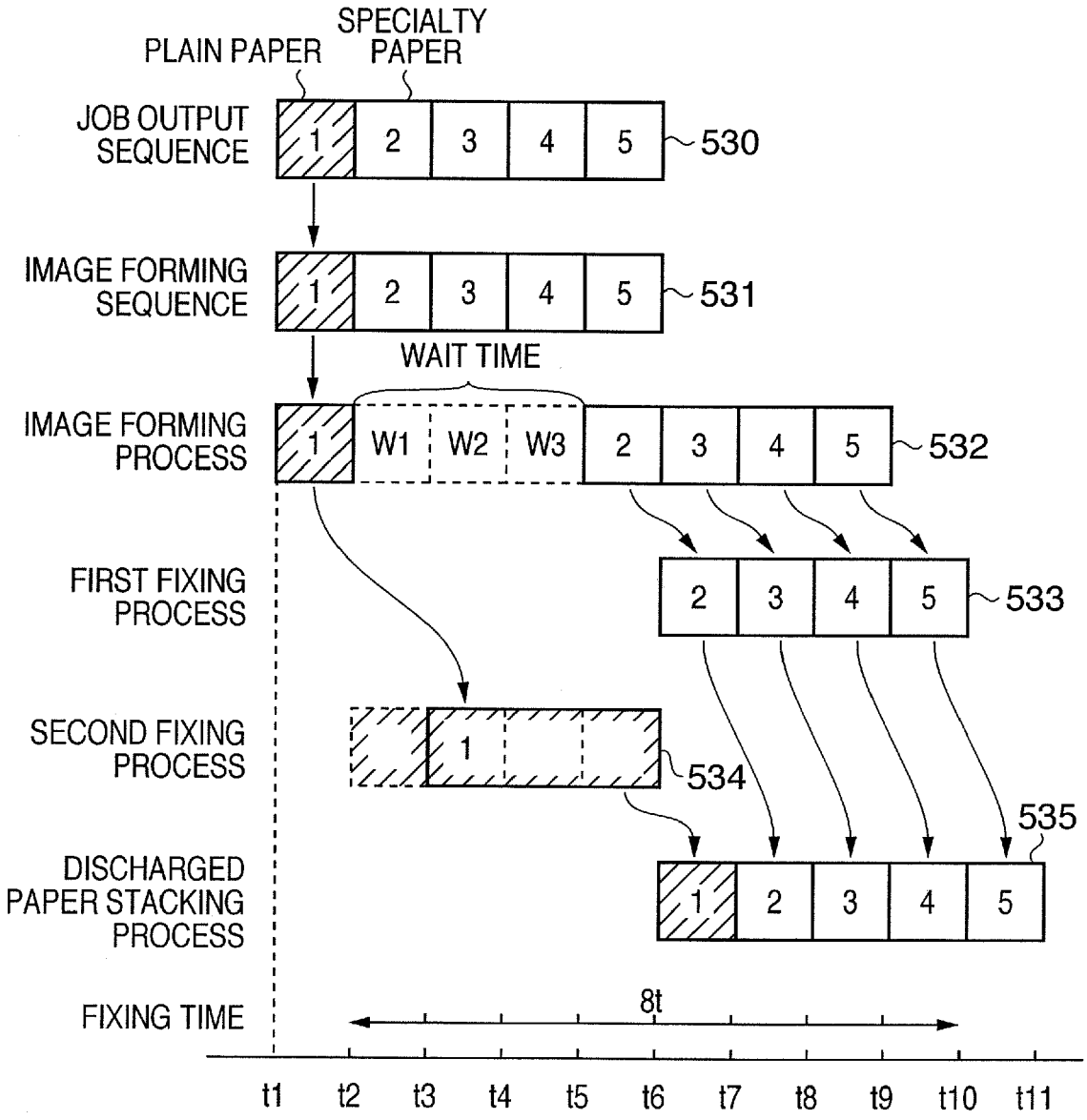
FIG. 5C is a view for explaining an image forming sequence change process and fixing time for a mixed job 530.
Figure 5D:
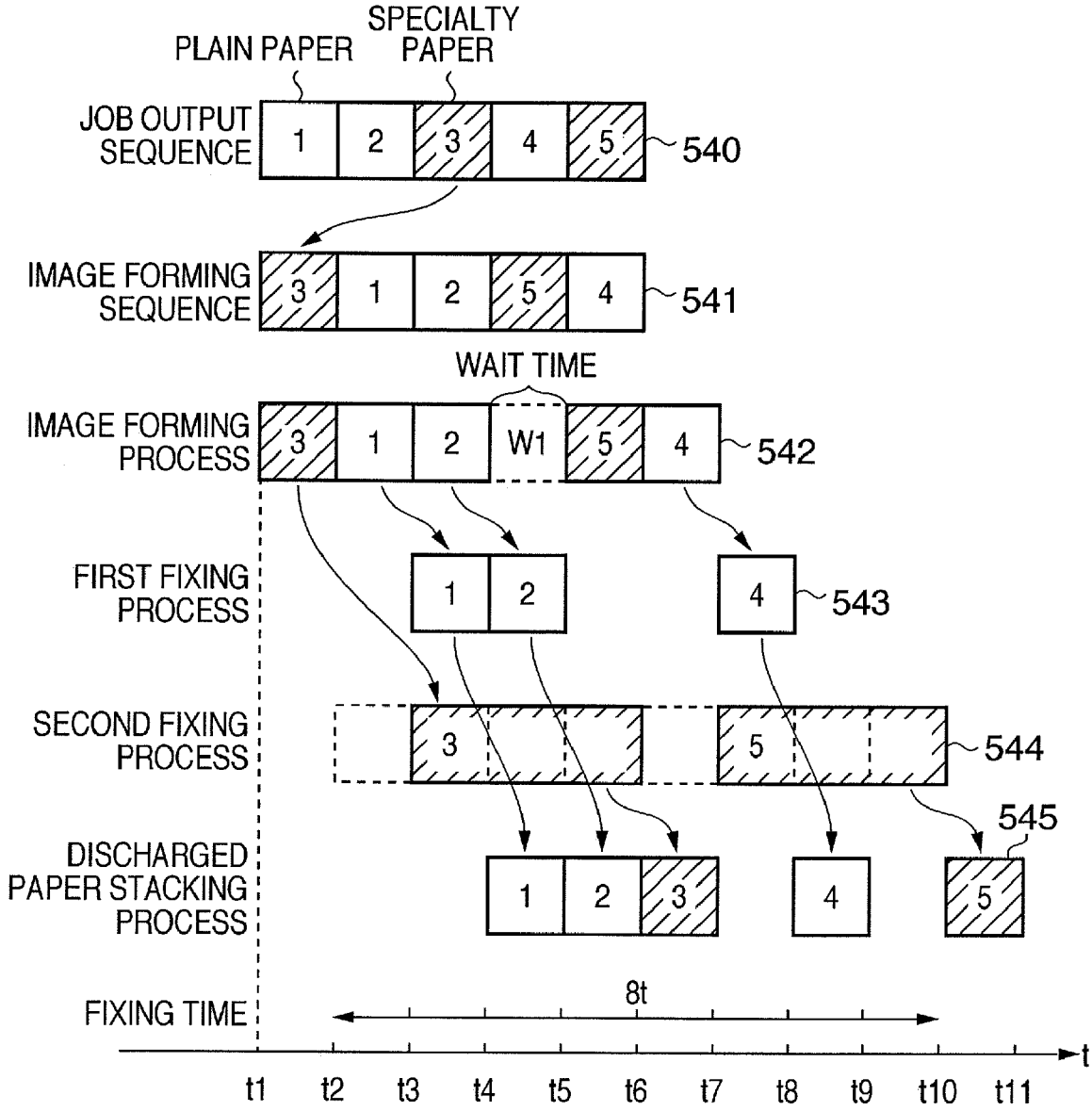
FIG. 5D is a view for explaining an image forming sequence change process and fixing time for a mixed job 540.
Figure 5E:
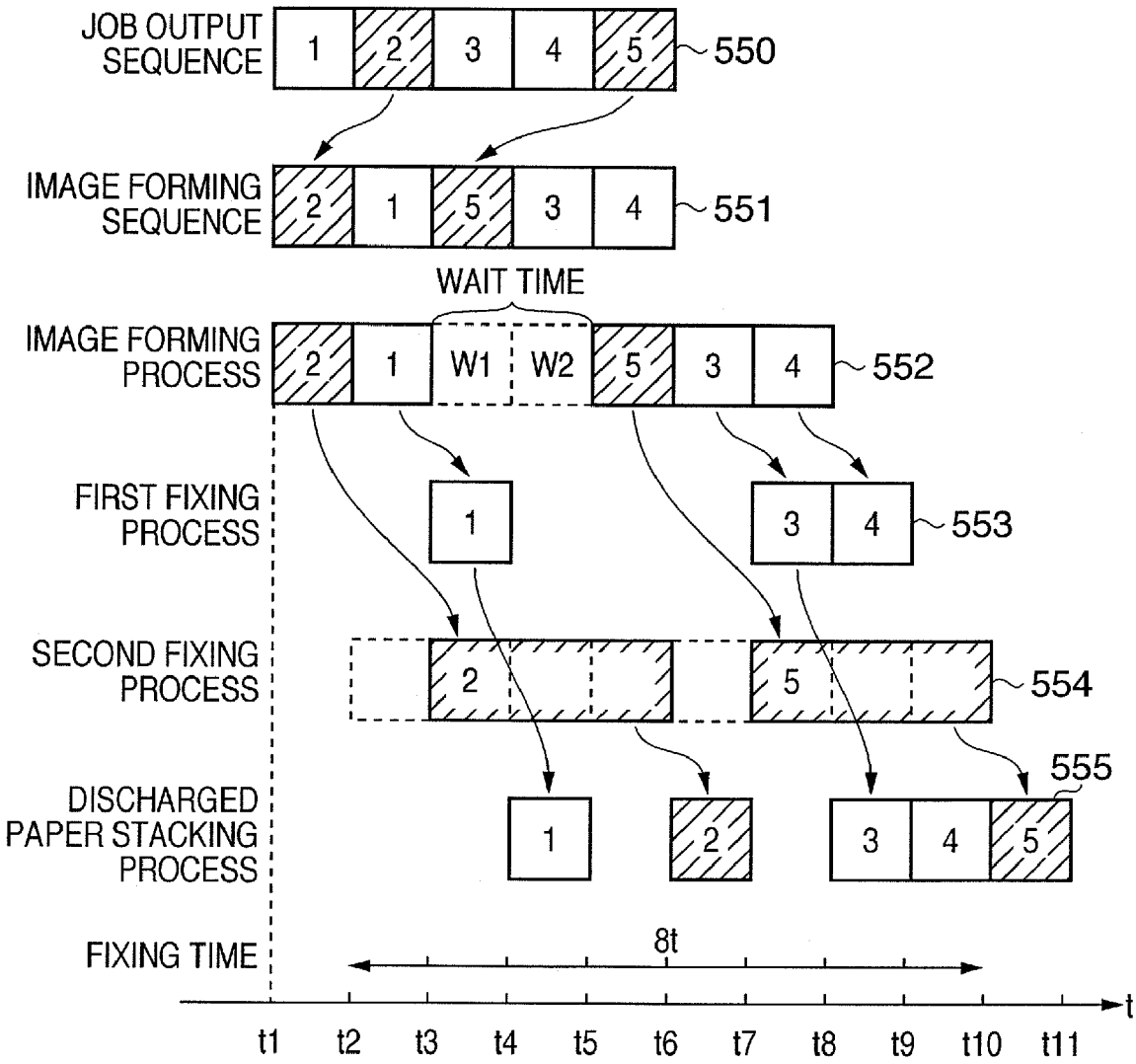
FIG. 5E is a view for explaining an image forming sequence change process and fixing time for a mixed job 550.
Figure 6A:
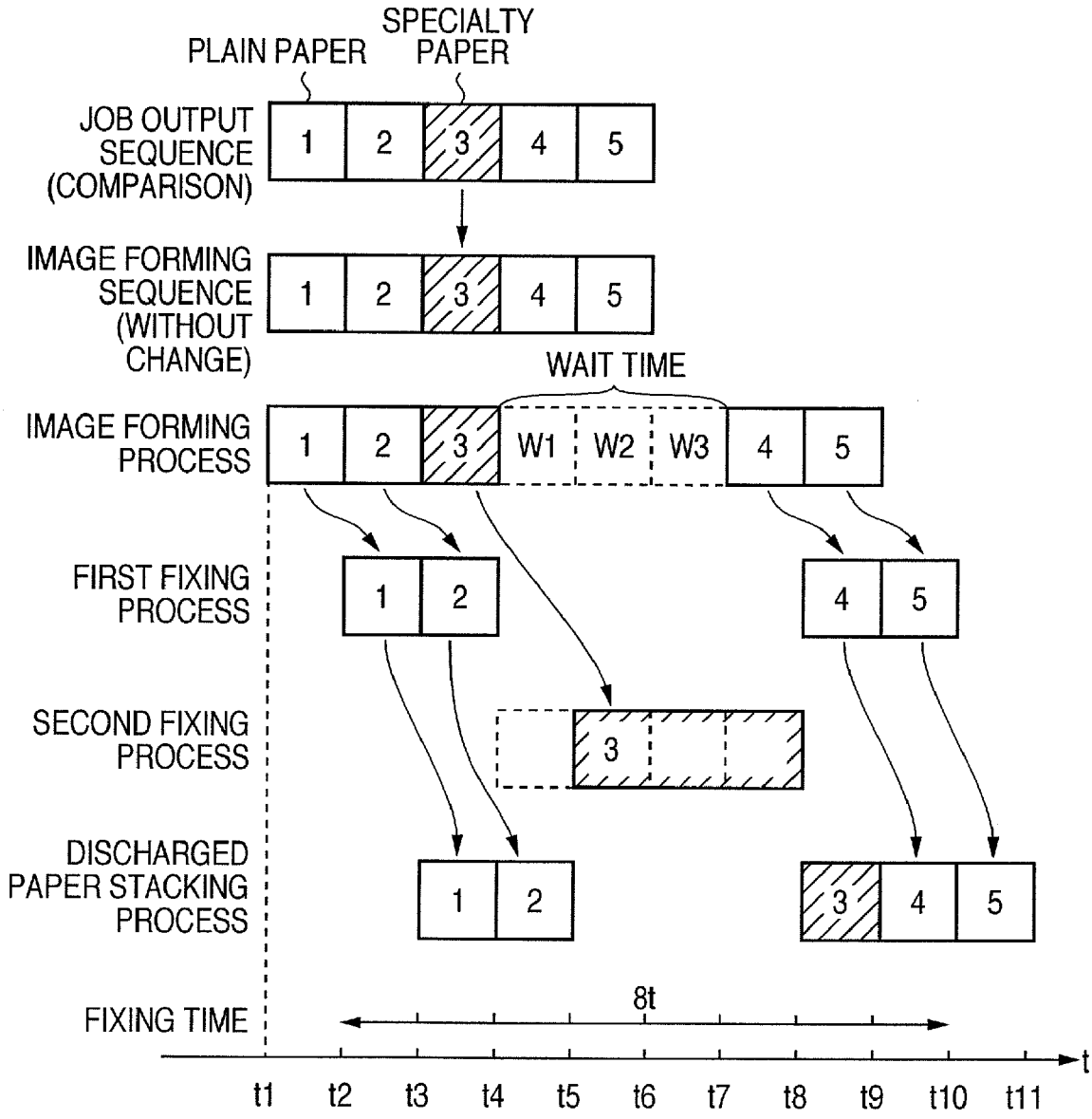
FIG. 6A is a view for explaining a comparative example of the mixed job 510.
Figure 6B:
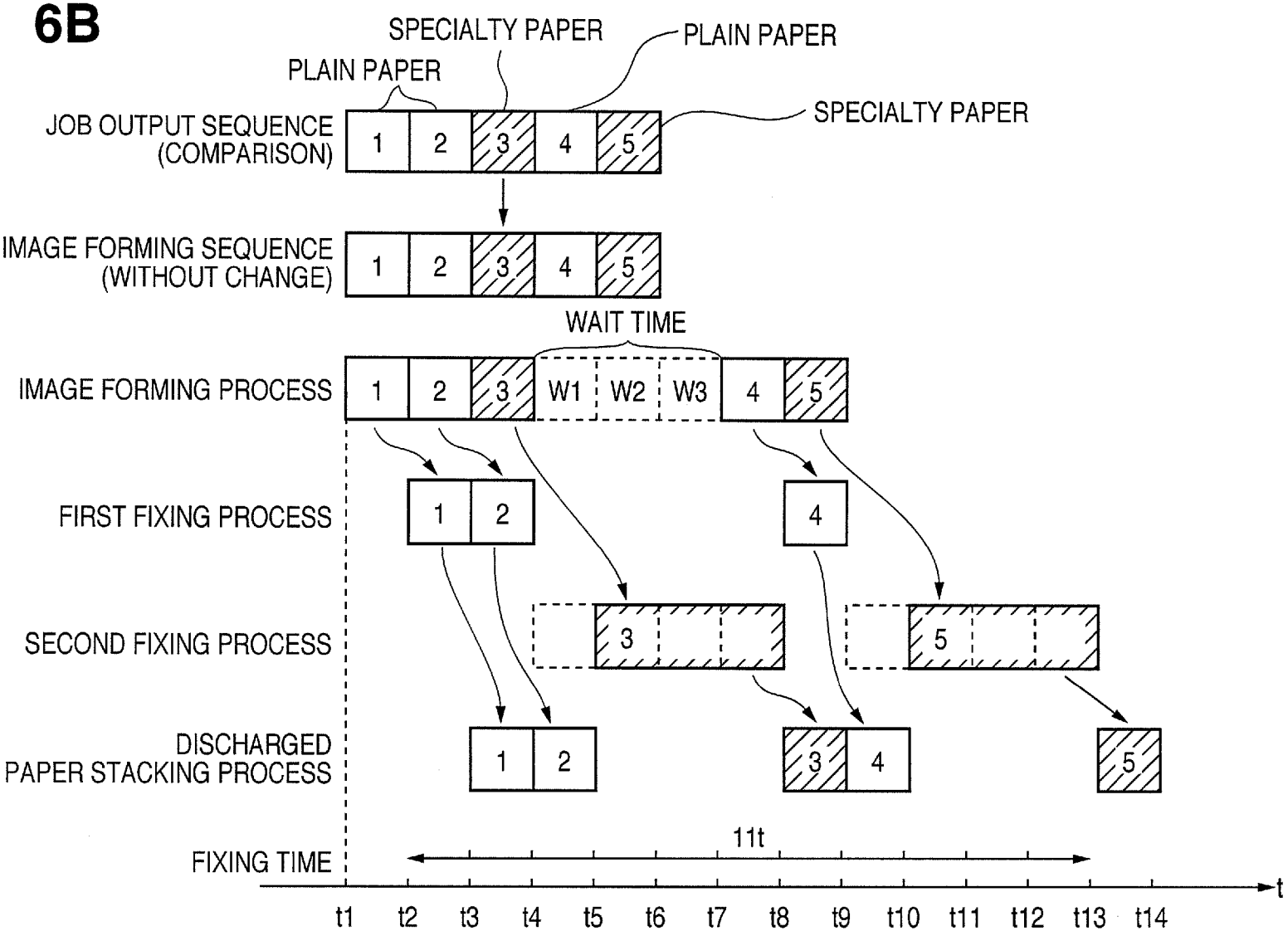
FIG. 6B is a view for explaining a comparative example of the mixed job 540.

Examples (FIGS. 5A to 5E) of the above-described process of changing the image forming sequence of the job (mixed job) containing plain paper and specialty paper (FIGS. 4A to 4C), which is executed by using the fixing unit 30 shown in FIG. 3A, will be described in association with comparative examples (FIGS. 6A and 6B).

EXAMPLE 1

Page 3 Uses Specialty Paper

FIG. 5A

FIG. 5A is a view for explaining an example (Example 1) of the image forming sequence change process of the job (mixed job) containing plain paper and specialty paper shown in FIG. 3C. In this job, the size of paper to be used for printing is A3. The predetermined relationship is set to count A:count B=less than 3:1. The process of changing the image sequence in the job (to be described below) is done within three images (S320, S350, and S370 in FIG. 4B). If the predetermined relationship allows to process four or more images, the number of images to be subjected to the process of changing the image sequence in the job can be increased.

A job output sequence 510 indicates the types and output sequence of paper sheets designated by the job shown in FIG. 3C. The image of page 3 is output to specialty paper while the images of pages 1, 2, 4, and 5 are output to plain paper.

An image forming sequence 511 indicates an image forming sequence obtained by changing the output sequence 510. The sequence of the images of pages 1 to 3 is changed by the process in steps S310→S320→S350→S370→S380 in FIG. 4B. In step S380, the image forming sequence is changed to move the image of page 3 to be output to specialty paper designated by the job to the top and the images of pages 1 and 2 to the second and third places. After the images of pages 3, 1, and 2 are formed, the wait time is set once. Next, the sequence of pages 4 and 5 is changed by the process in steps S340→S395→S320→S350→S370→S390. In step S390, the image sequence is changed. In this case, the sequence of the images of pages 4 and 5 does not change. As a result, the image forming sequence 511 is (3, 1, 2, 4, 5).

An image forming process 512 is an image forming process by the image forming unit and indicates the relationship of the timings and wait times of image formation (toner image formation and transfer) of five images according to the changed image forming sequence 511. The image forming unit forms the image of page 3 and then the images of pages 1 and 2 continuously. After the wait time is inserted once (wait time Δt is a predetermined time), the image forming unit continuously forms the images of pages 4 and 5.

A first fixing process 513 and second fixing process 514 indicate the timings of causing the first fixing device 30*a* or second fixing device 30*b* to fix the unfixed toner image formed by the image forming unit. Plain paper passes through the first fixing device 30*a* with a high fixing speed to fix an image. On the other hand, specialty paper is passed (preheated) through the first fixing device 30*a* first. Then, the specialty paper passes through the second fixing device 30*b* with a low fixing speed to fix an image. Hence, the image of page 3 that uses specialty paper is fixed by the second fixing device 30*b* during times t3 to t6 after passing through the first fixing device 30*a*. On the other hand, the first fixing device 30*a* fixes the image of page 1 that uses plain paper during the times t3 to t4, the image of page 2 that uses plain paper during the times t4 to t5, the image of page 4 that uses plain paper during the times t6 to t7, and the image of page 5 that uses plain paper during times t7 to t8.

A discharged paper stacking process 515 indicates a sequence of discharging and stacking the paper sheets with the images fixed by the first fixing device 30*a* or second fixing device 30*b*. The image stacking sequence is (1, 2, 3, 4, 5), as designated by the job.

COMPARATIVE EXAMPLE 1

Page 3 Uses Specialty Paper

FIG. 6A

FIG. 6A is a view showing a comparative example to FIG. 5A so as to explain the timings of image formation, fixing, and discharged paper stacking without changing the image forming sequence in the job shown in FIG. 3C.

The fixing time in FIG. 5A is compared with that in FIG. 6A. In FIG. 5A (Example 1), the fixing time is 6t (t is a fixing time per sheet of plain paper). In FIG. 6A (Comparative Example 1), the fixing time is 8t. As is apparent, the fixing time in Example 1 is shorter by a time corresponding to two sheets of plain paper. In FIG. 5A (Example 1), the two fixing devices are simultaneously used (the first fixing device 30*a* fixes the images of pages 1 and 2 while the second fixing device 30*b* is fixing the image of page 3). In FIG. 6A (Comparative Example 1), however, it is impossible to use the two fixing devices simultaneously. As a result, in Example 1, the fixing time can shorten by a time corresponding to two sheets of plain paper. The shortening effect is small because the above-described job outputs five pages. As the number of pages increases, the shortening effect is enhanced, and the output time shortens more conspicuously. It is therefore possible to improve the output productivity of a job (mixed job) containing specialty images that take a longer fixing time than plain images by placing the timing of specialty image formation before the timing of plain image output.

EXAMPLE 2

Page 2 Uses Specialty Paper

FIG. 5B

FIG. 5B is a view for explaining another example (Example 2) of the image forming sequence change process of the job (mixed job).

A job output sequence 520 indicates the types and output sequence of paper sheets designated by the job. The image of page 2 is output to specialty paper while the images of pages 1, 3, 4, and 5 are output to plain paper.

An image forming sequence 521 indicates an image forming sequence obtained by changing the output sequence 520. The sequence of the images of pages 1 and 2 is changed by the process in steps S310→S320→S350→S360 in FIG. 4B. In step S360, the image forming sequence is changed to move the image of page 2 to be output to specialty paper designated by the job to the top and the image of page 1 to the second place. After the images of pages 2 and 1 are formed, the wait time is set twice. Next, the sequence of pages 3 to 5 is changed by the process in steps S340→S395→S320→S350→S370→S390. In step S390, the image sequence is changed. In this case, the sequence of the images of pages 3, 4, and 5 does not change. As a result, the image forming sequence 521 is (2, 1, 3, 4, 5).

An image forming process 522 is an image forming process by the image forming unit and indicates the relationship of the timings and wait times of image formation (toner image formation and transfer) of five images according to the changed image forming sequence 521. The image forming unit forms the image of page 2 and then the image of page 1. After the wait time is inserted twice (wait time Δt is a predetermined time), the image forming unit continuously forms the images of pages 3, 4, and 5.

A first fixing process 523 and second fixing process 524 indicate the timings of causing the first fixing device 30*a* or second fixing device 30*b* to fix the unfixed toner image formed by the image forming unit. Plain paper passes through the first fixing device 30*a* with a high fixing speed to fix an image. On the other hand, specialty paper is passed (preheated) through the first fixing device 30*a* first. Then, the specialty paper passes through the second fixing device 30*b* with a low fixing speed to fix an image. Hence, the image of page 2 that uses specialty paper is fixed by the second fixing device 30*b* during the times t3 to t6 after passing through the first fixing device 30*a*. On the other hand, the first fixing device 30*a* fixes the image of page 1 that uses plain paper during the times t3 to t4, the image of page 3 that uses plain paper during the times t6 to t7, the image of page 4 that uses plain paper during the times t7 to t8, and the image of page 5 that uses plain paper during the times t8 to t9.

A discharged paper stacking process 525 indicates a sequence of discharging and stacking the paper sheets with the images fixed by the first fixing device 30*a* or second fixing device 30*b*. The image stacking sequence is (1, 2, 3, 4, 5), as designated by the job.

When the images are formed in accordance with the image forming sequence obtained by changing the output sequence 520, the fixing time is shorter by a time corresponding to a sheet of plain paper, as compared to a process without changing the image forming sequence. In FIG. 5B (Example 2), the two fixing devices are simultaneously used (the first fixing device 30*a* fixes the image of page 1 while the second fixing device 30*b* is fixing the image of page 2). In Example 2, the fixing time can shorten by a time corresponding to a sheet of plain paper. It is therefore possible to improve the output productivity of a job (mixed job) containing specialty images that take a longer fixing time than plain images by placing the timing of specialty image formation before the timing of plain image output.

EXAMPLE 3

Page 1 Uses Specialty Paper

FIG. 5C

FIG. 5C is a view for explaining still another example (Example 3) of the image forming sequence change process of the job (mixed job).

A job output sequence 530 indicates the types and output sequence of paper sheets designated by the job. The image of page 1 is output to specialty paper while the images of pages 2, 3, 4, and 5 are output to plain paper.

An image forming sequence 531 indicates an image forming sequence obtained by changing the output sequence 530. The sequence of the image of page 1 is changed by the process in steps S310→S320→S330 in FIG. 4B. In step S330, the image forming sequence keeps the image of page 1 to be output to specialty paper placed at the top (the sequence does not change). After the image of page 1 is formed, the wait time is set three times. Next, the sequence of pages 2 to 5 is changed by the process in steps S340→S395→S320→S350→S370→S390. In step S390, the image sequence is changed. In this case, however, the sequence of the images of pages 2 to 5 does not change. As a result, the image forming sequence 531 is (1, 2, 3, 4, 5).

An image forming process 532 is an image forming process by the image forming unit and indicates the relationship of the timings and wait times of image formation (toner image formation and transfer) of five images according to the changed image forming sequence 531. The image forming unit forms the image of page 1. After the wait time is inserted three times (wait time Δt is a predetermined time), the image forming unit continuously forms the images of pages 2, 3, 4, and 5.

A first fixing process 533 and second fixing process 534 indicate the timings of causing the first fixing device 30*a* or second fixing device 30*b* to fix the unfixed toner image formed by the image forming unit. Plain paper passes through the first fixing device 30*a* with a high fixing speed to fix an image. On the other hand, specialty paper is passed (preheated) through the first fixing device 30*a* first. Then, the specialty paper passes through the second fixing device 30*b* with a low fixing speed to fix an image. Hence, the image of page 1 that uses specialty paper is fixed by the second fixing device 30*b* during the times t3 to t6 after passing through the first fixing device 30*a*. On the other hand, the first fixing device 30*a* fixes the image of page 2 that uses plain paper during the times t6 to t7, the image of page 3 that uses plain paper during the times t7 to t8, the image of page 4 that uses plain paper during the times t8 to t9, and the image of page 5 that uses plain paper during the times t9 to t10.

A discharged paper stacking process 535 indicates a sequence of discharging and stacking the paper sheets with the images fixed by the first fixing device 30*a* or second fixing device 30*b*. The image stacking sequence is (1, 2, 3, 4, 5), as designated by the job.

As described above, when page 1 uses specialty paper, the sequence need not be changed for image formation, and the fixing time does not shorten.

EXAMPLE 4

Pages 3 and 5 Use Specialty Paper

FIG. 5D

FIG. 5D is a view for explaining still another example (Example 4) of the image forming sequence change process of the job (mixed job).

A job output sequence 540 indicates the types and output sequence of paper sheets designated by the job. The images of pages 3 and 5 are output to specialty paper while the images of pages 1, 2, and 4 are output to plain paper.

An image forming sequence 541 indicates an image forming sequence obtained by changing the output sequence 540. The sequence of the images of pages 1 to 3 is changed by the process in steps S310→S320→S350→S370→S380 in FIG. 4B. In step S380, the image forming sequence is changed to move the image of page 3 to be output to specialty paper designated by the job to the top and the images of pages 1 and 2 to the second and third places. After the images of pages 3, 1, and 2 are formed, the wait time is set once. Next, the sequence of pages 4 and 5 is changed by the process in steps S340→S395→S320→S350→S360. In step S360, the image sequence is changed to place the image of page 5 to be output to specialty paper designated by the job before the image of page 4. As a result, the image forming sequence 541 is (3, 1, 2, 5, 4).

An image forming process 542 is an image forming process by the image forming unit and indicates the relationship of the timings and wait times of image formation (toner image formation and transfer) of five images according to the changed image forming sequence 541. The image forming unit forms the image of page 3 and then the images of pages 1 and 2 continuously. After the wait time is inserted once (wait time Δt is a predetermined time), the image forming unit continuously forms the images of pages 5 and 4.

A first fixing process 543 and second fixing process 544 indicate the timings of causing the first fixing device 30*a* or second fixing device 30*b* to fix the unfixed toner image formed by the image forming unit. Plain paper passes through the first fixing device 30*a* with a high fixing speed to fix an image. On the other hand, specialty paper is passed (preheated) through the first fixing device 30*a* first. Then, the specialty paper passes through the second fixing device 30*b* with a low fixing speed to fix an image. Hence, the images of pages 3 and 5 that use specialty paper are fixed by the second fixing device 30*b* during the times t3 to t6 and the times t7 to t10, respectively, after passing through the first fixing device 30*a*. On the other hand, the first fixing device 30*a* fixes the image of page 1 that uses plain paper during the times t3 to t4, the image of page 2 that uses plain paper during the times t4 to t5, and the image of page 4 that uses plain paper during the times t7 to t8.

A discharged paper stacking process 545 indicates a sequence of discharging and stacking the paper sheets with the images fixed by the first fixing device 30*a* or second fixing device 30*b*. The image stacking sequence is (1, 2, 3, 4, 5), as designated by the job.

COMPARATIVE EXAMPLE 2

Pages 3 and 5 Use Specialty Paper

FIG. 6B

FIG. 6B is a view showing a comparative example to FIG. 5D so as to explain the timings of image formation, fixing, and discharged paper stacking when the images are formed without changing the image forming sequence in the job. The fixing time in FIG. 5D (Example 4) is compared with that in FIG. 6B (Comparative Example 2). In FIG. 5D (Example 4), the fixing time is 8t (t is a fixing time per sheet of plain paper). In FIG. 6B (Comparative Example 2), the fixing time is 11t. As is apparent, the fixing time in Example 4 is shorter by a time corresponding to three sheets of plain paper. In FIG. 5D, the two fixing devices are simultaneously used (the first fixing device 30*a* fixes the images of pages 1 and 2 while the second fixing device 30*b* is fixing the image of page 3, and the first fixing device 30*a* fixes the image of page 4 while the second fixing device 30*b* is fixing the image of page 5). In FIG. 6B, however, it is impossible to use the two fixing devices simultaneously. As a result, in Example 4, the fixing time can shorten by a time corresponding to three sheets of plain paper.

EXAMPLE 5

Pages 2 and 5 Use Specialty Paper

FIG. 5E

FIG. 5E is a view for explaining still another example (Example 5) of the image forming sequence change process of the job (mixed job).

A job output sequence 550 indicates the types and output sequence of paper sheets designated by the job. The images of pages 2 and 5 are output to specialty paper while the images of pages 1, 3, and 4 are output to plain paper.

An image forming sequence 551 indicates an image forming sequence obtained by changing the output sequence 550. The sequence of the images of pages 1 and 2 is changed by the process in steps S310→S320→S350→S360 in FIG. 4B. In step S360, the image forming sequence is changed to move the image of page 2 to be output to specialty paper designated by the job to the top and the image of page to the second place. After the images of pages 2 and 1 are formed, the wait time is set twice. Next, the sequence of pages 3 to 5 is changed by the process in steps S340→S395→S320→S350→S370→S380. In step S380, the image sequence is changed to place the image of page 5 to be output to specialty paper designated by the job before the images of pages 3 and 4. As a result, the image forming sequence 551 is (2, 1, 5, 3, 4).

An image forming process 552 is an image forming process by the image forming unit and indicates the relationship of the timings and wait times of image formation (toner image formation and transfer) of five images according to the changed image forming sequence 551. The image forming unit forms the image of page 2 and then the image of page 1. After the wait time is ®inserted twice (wait time Δt is a predetermined time), the image forming unit continuously forms the images of pages 5, 3, and 4.

A first fixing process 553 and second fixing process 554 indicate the timings of causing the first fixing device 30*a* or second fixing device 30*b* to fix the unfixed toner image formed by the image forming unit. Plain paper passes through the first fixing device 30*a* with a high fixing speed to fix an image. On the other hand, specialty paper is passed (preheated) through the first fixing device 30*a* first. Then, the specialty paper passes through the second fixing device 30*b* with a low fixing speed to fix an image. Hence, the images of pages 2 and 5 that use specialty paper are fixed by the second fixing device 30*b* during the times t3 to t6 and the times t7 to t10, respectively, after passing through the first fixing device 30*a*. On the other hand, the first fixing device 30*a* fixes the image of page 1 that uses plain paper during the times t3 to t4, the image of page 3 that uses plain paper during the times t7 to t8, and the image of page 4 that uses plain paper during the times t8 to t9.

A discharged paper stacking process 555 indicates a sequence of discharging and stacking the paper sheets with the images fixed by the first fixing device 30*a* or second fixing device 30*b*. The image stacking sequence is (1, 2, 3, 4, 5), as designated by the job.

When the images are formed in accordance with the image forming sequence obtained by changing the output sequence 550, the fixing time is shorter by a time corresponding to three sheets of plain paper, as compared to a process without changing the image forming sequence. In FIG. 5E (Example 5), the two fixing devices are simultaneously used (the first fixing device 30*a* fixes the image of page 1 while the second fixing device 30*b* is fixing the image of page 2, and the first fixing device 30*a* fixes the images of pages 3 and 4 while the second fixing device 30*b* is fixing the image of page 5). As a result, in Example 5, the fixing time can shorten by a time corresponding to three sheets of plain paper.

It is therefore possible to improve the output productivity of a job (mixed job) containing specialty images that take a longer fixing time than plain images by placing the timing of specialty image formation before the timing of plain image output.

[When Fixing Unit 30 with Arrangement in FIG. 3B is Used]

In the above-described examples, the two fixing devices of the fixing unit 30 shown in FIG. 3A are used.

However, when two fixing devices are juxtaposed and separately used, as in the fixing unit 30 shown in FIG. 3B, the degree of freedom of the image forming sequence can further be increased as compared to the process using the two fixing devices of the fixing unit 30 shown in FIG. 3A.

In the fixing unit 30 shown in FIG. 3B, the first fixing device 30*a* is used to only fix a toner image transferred to the plain paper A1, and the second fixing device 30*b* is used to only fix a toner image transferred to the specialty paper A2. Assume that the first fixing device 30*a* for plain paper has the first fixing speed (300 mm/s, paper passage time: 1.4 sec/A3), and the second fixing device 30*b* for specialty paper has the second fixing speed (50 mm/s, paper passage time: 8.4 sec/A3).

In this case, the first fixing device 30*a* and second fixing device 30*b* are used independently in correspondence with the paper type. For this reason, it is necessary to provide the two or more conveyance paths L9, L10, and L11 on the side of the second fixing device 30*b*. The conveyance path on the side of the first fixing device 30*a* is therefore shorter than that on the side of the second fixing device 30*b*. For this reason, in the arrangement of the fixing unit 30 shown in FIG. 3B, the number of paper sheets which are subjected to fixing by the first fixing device 30*a* and discharged to the discharge unit while the second fixing device 30*b* is executing fixing increases, as compared to the arrangement of the fixing unit 30 shown in FIG. 3A. The arrangement of the fixing unit 30 shown in FIG. 3B allows to decrease the wait time in fixing specialty paper, as compared to the arrangement of the fixing unit 30 shown in FIG. 3A. Consequently, it is possible to further improve the output productivity of a job (mixed job) containing specialty images that take a longer fixing time than plain images by placing the timing of specialty image formation before the timing of plain image output.

In the above-described embodiment, the paper size is A3, and the length of the conveyance unit also corresponds to A3. However, the paper size and the length of the conveyance unit can freely be changed. The upper limit number of pages that allows image forming sequence change can also be determined based on it.

Second Embodiment

The second embodiment will be described below. An image forming apparatus of the second embodiment is similar to that of the first embodiment. Hence, the image forming apparatus of the second embodiment will be described placing focus on only parts different from that of the first embodiment, and a description of common parts will not be repeated.

[Features]

In the first embodiment, the output productivity of a job (mixed job) using plain paper and specialty paper (high-gloss mode) is improved by optimizing the image forming sequence by, e.g., placing the timing of specialty image formation using specialty paper before the timing of plain image output. In the second embodiment, a case wherein the image forming sequence optimization is applied to a gloss mode with a different toner application amount or toner type. The gloss mode controls the gloss of a final image by using a transparent toner independently of the properties of paper. In the gloss mode, a transparent toner is applied to a blank part (unprinted part), thereby eliminating the step difference between an image part and a non-image part, although the process changes depending on the paper surface conditions. In the gloss mode, an image may be formed by covering color toners, as needed. In the normal image forming mode (corresponding to the above-described plain image), fixing is done by a first fixing device 30*a*. In the gloss mode (corresponding to the above-described specialty image), fixing is done at a high temperature by the first fixing device 30*a* and a second fixing device 30*b*. Even in the second embodiment, it is therefore possible to improve the output productivity by the same process as in the first embodiment. In other words, it is possible to improve the output productivity of a job (mixed job) containing the gloss mode that takes a longer fixing time (requires fixing at a higher temperature or supply of a larger amount of heat) than the normal image forming mode by optimizing the image forming sequence by, e.g., placing the timing of image formation in the gloss mode before the timing of output in the normal image forming mode.

Figure 7:
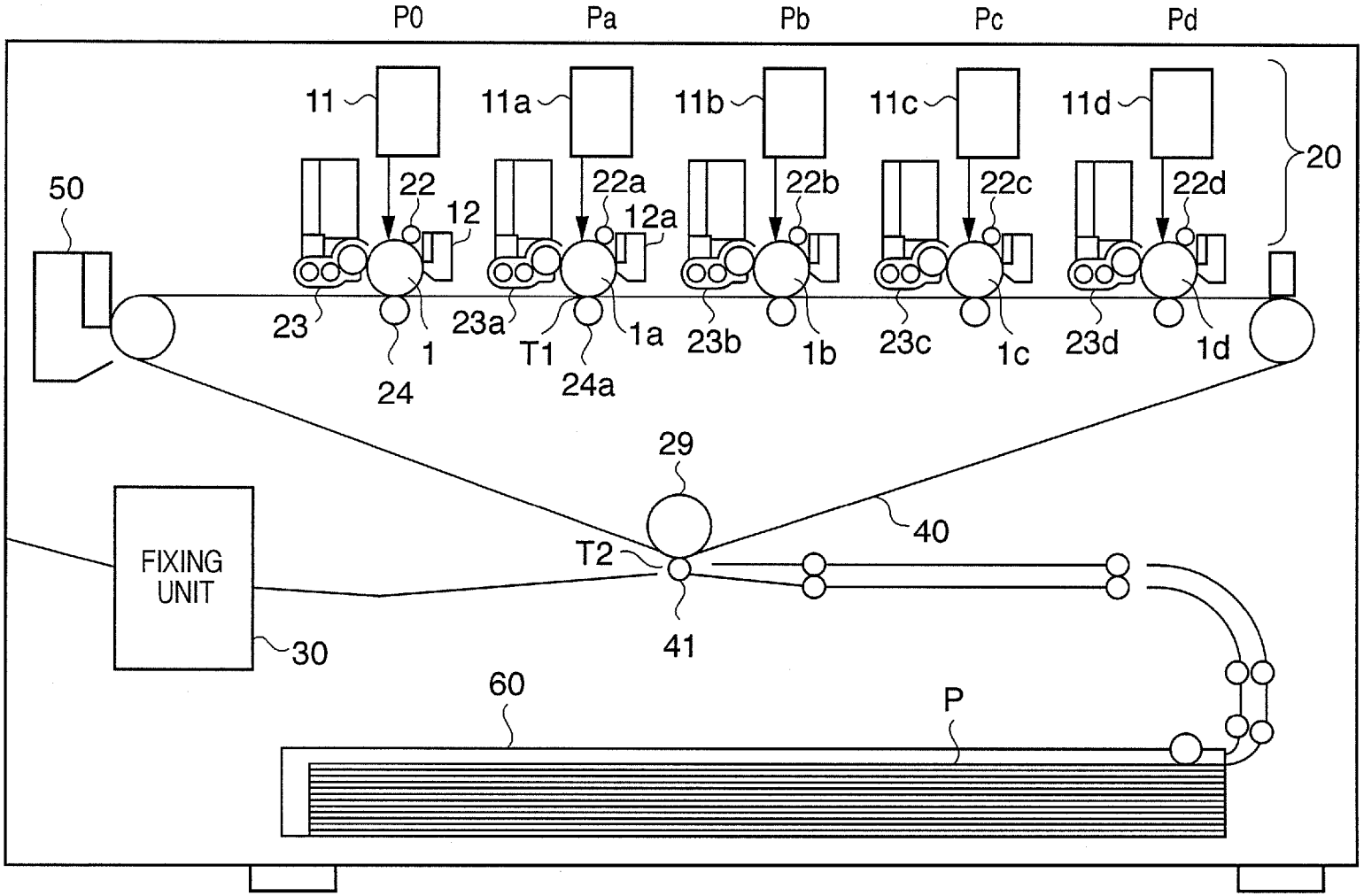
FIG. 7 is a schematic sectional view showing the arrangement of an image forming apparatus according to the second embodiment of the present invention.

[Image Forming Apparatus: FIG. 7]

FIG. 7 is a sectional view of a color image forming apparatus as an example of an image forming system according to the second embodiment. The image forming apparatus of the second embodiment is different from that of the first embodiment in that a transparent toner image forming station P0 is added. The transparent toner image forming station P0 includes a photosensitive drum 1, primary charger 22, image exposure unit 11, developing device 23, primary transfer roller 24, and cleaning unit 12, like image forming stations Pa, Pb, Pc, and Pd.

The transparent toner controls the gloss of a final image independently of the properties of paper. The transparent toner need not always have the same viscoelastic characteristic as the color toners of the remaining image forming stations. The image forming apparatus of the second embodiment can control the gloss of a final image by using the transparent toner. More specifically, in the gloss mode, the transparent toner is applied to a blank part (part without an image), thereby eliminating the step difference between an image part and a non-image part. In the gloss mode, the second fixing device with a low speed executes fixing at a high temperature. This enables to obtain a final image without the step difference between an image part and a non-image part.

In the normal image forming mode, the first fixing device executes fixing at a normal image forming speed because no transparent toner is used.

The image forming modes such as the plain paper/specialty paper mix mode, normal image forming mode, and gloss mode are set via an input unit 80 or based on image forming information received from an external device.

Other Embodiments

The object of the embodiments may be achieved by supplying a storage medium which records software program codes to implement the functions of the embodiments to a system or apparatus. The computer (or CPU or MPU) of the system or apparatus reads out and executes the program codes stored in the storage medium.

In this case, the program codes read out from the storage medium themselves implement the functions of the above-described embodiments. The program codes and the storage medium storing them constitute the present invention.

Examples of the storage medium to supply the program codes are a floppy® disk, hard disk, magnetooptical disk, CD-ROM, CD-R, and CD-RW. A DVD-ROM, DVD-RAM, DVD-RW, DVD+RW, magnetic tape, nonvolatile memory card, and ROM are also usable. The program codes may be downloaded via a network.

The program codes read out from the storage medium are written in the memory of a function expansion board inserted to the computer or a function expansion unit connected to the computer. The CPU of the function expansion board or function expansion unit partially or wholly executes actual processing based on the instructions of the program codes, thereby implementing the functions of the above-described embodiments.

A computer executes the readout program codes, thereby implementing the functions of the above-described embodiments. Otherwise, the OS running on the computer partially or wholly executes actual processing based on the instructions of the program codes, thereby implementing the functions of the above-described embodiments, as a matter of course.

In this case, the program is supplied directly from the storage medium storing it or downloaded from another computer (not shown) or database connected to the Internet, a commercial network or local area network.

In the above-described embodiments, the output method of the image forming apparatus is an electrophotographic method. However, the present invention is not limited to the electrophotographic method and is also applicable to various kinds of output methods such as an inkjet method, thermal transfer method, thermal printing method, electrostatic method, and electrosensitive printing method.

The program can take any form such as an object code, a program code to be executed by an interpreter, or script data to be supplied to the OS (Operating System).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-261414 filed on Sep. 26, 2006, which is hereby incorporated by reference herein in its entirety.

What is claimed is:

1. An image forming system comprising:

an image forming unit adapted to form an image as a toner image on a printing medium;

a first fixing unit adapted to fix, on the printing medium, the toner image formed by said image forming unit;

a second fixing unit arranged at a position different from said first fixing unit and used when a larger amount of heat is necessary for fixing the toner image on the printing medium; and a control unit adapted to change a sequence of images formed by said image forming unit so that a toner image fixed on a first medium by using said second fixing unit is formed before a toner image fixed on a second medium without using said second fixing unit, wherein in a case where the sequence of images is changed, said control unit controls conveyance of the first medium and the second medium so that the first medium and the second medium are discharged in order of the sequence of images before the change.

2. The system according to claim 1, wherein said image forming unit forms the image as the toner image on the printing medium based on image forming information for forming images in an output sequence received from an external device.

3. The system according to claim 2, wherein said control unit changes the sequence of images formed by said image forming unit by changing a sequence of pieces of the image forming information, thereby shortening a fixing time of toner images on the printing medium, the toner images corresponding to all pieces of image forming information in the output sequence.

4. The system according to claim 3, wherein said control unit changes the sequence of images within a range of output in the output sequence so that image forming information which requires a large amount of heat to fix the toner image on the printing medium is placed before image forming information which does not require a large amount of heat to fix the toner image on the printing medium.

5. The system according to claim 1, wherein the system is configured to add an adjustment time to an image formation time in order to correspond to the sequence of images changed by said control unit.

6. The system according to claim 2, wherein the image forming information includes one of image data, paper type information indicating one of plain paper serving as the printing medium and specialty paper different from the plain paper, an image forming mode, and designation information indicating one of said first fixing unit and said second fixing unit to be used in correspondence with the paper type information or the image forming mode.

7. The system according to claim 6, wherein the image forming mode includes a mix mode to form images on the plain paper and the specialty paper and a gloss mode to designate gloss of an image.

8. The system according to claim 7, wherein said image forming unit has a color toner and a transparent toner and forms the image by using the transparent toner when the image forming mode is the gloss mode.

9. The system according to claim 6, wherein the image forming information includes one of designation information of said second fixing unit, paper type information of the specialty paper, and a gloss mode.

10. A control method of an image forming system, comprising the steps of:

forming an image as a toner image on a printing medium;

performing first fixing to fix, on the printing medium, the toner image formed in the image forming step;

performing second fixing to fix the toner image on the printing medium when a larger amount of heat is necessary for fixing the toner image on the printing medium; and controlling a sequence of image formation in the image forming step so that a toner image to be fixed on a first medium by the second fixing step is formed before a toner image to be fixed on a second medium without the second fixing step, wherein in a case where the sequence of images is changed, said control unit controls conveyance of the first medium and the second medium so that the first medium and the second medium are discharged in order of the sequence of images before the change.

11. The method according to claim 10, wherein in the image forming step, the image as the toner image is formed on the printing medium based on image forming information in an output sequence.

12. The method according to claim 11, wherein in the controlling step, the sequence of images formed in the image forming step is changed by changing a sequence of pieces of the image forming information, thereby shortening a fixing time of toner images on the printing medium, the toner images corresponding to all pieces of image forming information output in the output sequence.

13. The method according to claim 12, wherein in the controlling step, the sequence of forming images is changed within a range of output in the output sequence so that image forming information which requires a large amount of heat to fix the toner image on the printing medium is placed before image forming information which does not require a large amount of heat to fix the toner image on the printing medium.

14. The method according to claim 10, further comprising the step of inserting an adjustment time for adjusting an image formation time in order to correspond to the sequence of images changed in the controlling step.

15. The method according to claim 11, wherein the image forming information includes one of image data, paper type information indicating one of plain paper serving as the printing medium and specialty paper different from the plain paper, an image forming mode, and designation information of one of the first fixing step and the second fixing step to be used in correspondence with the paper type information or the image forming mode.

16. The method according to claim 15, wherein the image forming mode includes a mix mode to form images on the plain paper and the specialty paper and a gloss mode to designate gloss of an image.

17. The method according to claim 16, wherein in the image forming step, the image is formed by using a transparent toner when the image forming mode is the gloss mode.

18. The method according to claim 15, wherein the image forming information includes one of designation information of the second fixing step, paper type information of the specialty paper, and a gloss mode.

* * * * *